US005904352A

United States Patent [19]

Takemoto

[11] Patent Number: 5,904,352

[45] Date of Patent: May 18, 1999

[54] PACHINKO GAME MACHINE HAVING CARD GAME PLAYING FUNCTION

[75] Inventor: Takatoshi Takemoto, Tokyo, Japan

[73] Assignee: Kabushiki Kaisha Ace Denken, Tokyo, Japan

[21] Appl. No.: 08/930,538

[22] PCT Filed: Mar. 19, 1996

[86] PCT No.: PCT/JP96/00721

§ 371 Date: Sep. 29, 1997

§ 102(e) Date: Sep. 29, 1997

[87] PCT Pub. No.: WO96/30095

PCT Pub. Date: Oct. 3, 1996

[30] Foreign Application Priority Data

Mar. 29, 1995 [JP] Japan ..... 7-071865

[51] Int. Cl.[6] ..... A63F 7/02

[52] U.S. Cl. ..... 273/121 B

[58] Field of Search ..... 273/118 R, 118 A, 273/119 R, 119 A, 121 R, 121 A, 121 B

[56] References Cited

FOREIGN PATENT DOCUMENTS

| | | | |
|---|---|---|---|
| 63-21511 | 1/1983 | Japan . | |
| 59-100476 | 7/1984 | Japan . | |
| 62-149387 | 9/1987 | Japan . | |
| 63-11185 | 1/1988 | Japan . | |
| 64-68289 | 3/1989 | Japan . | |
| 2-5102 | 1/1990 | Japan . | |
| 2-29350 | 6/1990 | Japan . | |
| 4-96778 | 3/1992 | Japan | 273/121 B |
| 4-341289 | 11/1992 | Japan . | |
| 6-71020 | 3/1994 | Japan | 273/121 B |
| 6-71021 | 3/1994 | Japan | 273/121 B |
| 6-269536 | 9/1994 | Japan | 273/121 B |

*Primary Examiner*—Raleigh W. Chiu
*Attorney, Agent, or Firm*—Seed and Berry LLP

[57] ABSTRACT

This invention provides a pachinko game machine having a card game playing function, to play a game enjoying the atmosphere of playing a card game. When a pachinko ball drops into the specific winning section 104, the card symbol display section 107 displays on the five display positions five symbols out of the symbols representing the fifty-two cards in a regular deck. The variable winning section 105 changes into a big-winning state the predetermined number of times when the five symbols displayed on the five display positions form one of the winning combinations in the card game. During the big-winning state, a plurality of pachinko balls may drop at a time into the variable winning section. One big-winning state is completed when a predetermined time period lapses after the big-winning state starts, or when the number of pachinko balls having dropped into the variable winning section reaches a predetermined number.

31 Claims, 35 Drawing Sheets

| WINNING COMBINATIONS IN THE POKER GAME | NUMBER OF CHANGES | CONDITIONS |
|---|---|---|
| Two Pairs | 2 | Only two symbols with the same number are included |
| Three of a Kind | 4 | Only three symbols with the same number are included |
| Straight | 6 | The symbols have five sequential numbers |
| Flush | 8 | All the symbols have the same suit |
| Full House | 10 | The symbols comprise two symbols with the same number and three symbols with another same number |
| Four of a Kind | 16 | Only four symbols with the same number are included |

*Fig. 2*

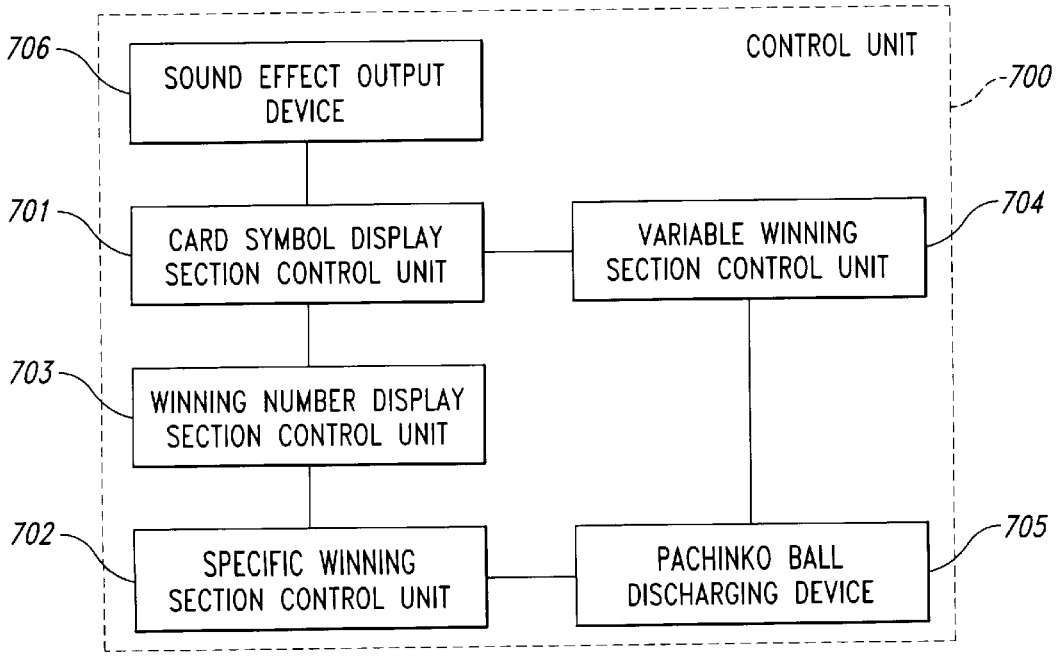

*Fig. 3*

| WINNING COMBINATIONS IN THE POKER GAME | RELEASING TIME | CONDITIONS |
|---|---|---|
| Two Pairs | 4 (Seconds) | Only two symbols with the same number are included |
| Three of a Kind | 8 (Seconds) | Only three symbols with the same number are included |
| Straight | 12 (Seconds) | The symbols have five sequential numbers |
| Flush | 16 (Seconds) | All the symbols have the same suit |
| Full House | 20 (Seconds) | The symbols comprise two symbols with the same number and three symbols with another same number |
| Four of a Kind | 30 (Seconds) | Only four symbols with the same number are included |

*Fig. 17*

| WINNING COMBINATIONS IN THE POKER GAME | RELEASING NUMBER | CONDITIONS |
|---|---|---|
| Two Pairs | 2 | Only two symbols with the same number are included |
| Three of a Kind | 3 | Only three symbols with the same number are included |
| Straight | 4 | The symbols have five sequential numbers |
| Flush | 5 | All the symbols have the same suit |
| Full House | 6 | The symbols comprise two symbols with the same number and three symbols with another same number |
| Four of a Kind | 10 | Only four symbols with the same number are included |

*Fig. 23*

| WINNING COMBINATIONS IN THE POKER GAME | DISCHARGING NUMBER | CONDITIONS |
|---|---|---|
| Two Pairs | 2 | Only two symbols with the same number are included |
| Three of a Kind | 4 | Only three symbols with the same number are included |
| Straight | 6 | The symbols have five sequential numbers |
| Flush | 8 | All the symbols have the same suit |
| Full House | 10 | The symbols comprise two symbols with the same number and three symbols with another same number |
| Four of a Kind | 15 | Only four symbols with the same number are included |

*Fig. 29*

| WINNING COMBINATIONS IN THE POKER GAME | UPPER LIMIT VALUE | CONDITIONS |
|---|---|---|
| Two Pairs | 100 | Only two symbols with the same number are included |
| Three of a Kind | 80 | Only three symbols with the same number are included |
| Straight | 60 | The symbols have five sequential numbers |
| Flush | 40 | All the symbols have the same suit |
| Full House | 20 | The symbols comprise two symbols with the same number and three symbols with another same number |
| Four of a Kind | 10 | Only four symbols with the same number are included |

*Fig. 36*

WINNING-COMBINATION-AND-TIMES TABLE

| WINNING COMBINATIONS IN THE POKER GAME | NUMBER-OF -CHANGE | CONDITIONS | UPPER LIMIT VALUE | FORMED-NUMBER-OF-TIMES |
|---|---|---|---|---|
| Two Pairs | 2 | Only two symbols with the same number are included | 100 | |
| Three of a Kind | 4 | Only three symbols with the same number are included | 80 | |
| Straight | 6 | The symbols have five sequential numbers | 60 | |
| Flush | 8 | All the symbols have the same suit | 40 | |
| Full House | 10 | The symbols comprise two symbols with the same number and three symbols with another same number | 20 | |
| Four of a Kind | 16 | Only four symbols with the same number are included | 10 | |

4301

*Fig. 39*

PACHINKO GAME MACHINE HAVING CARD GAME PLAYING FUNCTION

TECHNICAL FIELD

This invention relates to a pachinko (Japanese pinball) game machine having card game playing function with which a player can play a game with the atmosphere of a card game.

BACKGROUND TECHNIQUE

A pachinko game machine is a game machine having a vertically arranged gaming board on which a number of obstruction nails are dispercedly provided, with which a player successively propels pachinko balls, being game play media, from a lower position of the game machine toward an upper position in a vertical direction so as to drop the pachinko balls into a winning section (hole) provided on the gaming board. A predetermined number of pachinko balls are discharged into a tray provided at the bottom of the game machine when a pachinko ball drops into a winning section. The pachinko balls discharged into the tray can be used for propelling onto the gaming board again. Pachinko balls which have not dropped into any winning sections are collected through a missing ball discharging section. Players can exchange the pachinko balls they retain for various gifts in accordance with the number of retained pachinko balls.

According to one such pachinko game machine, there is provided, on the gaming board, a variable winning section which receives a plurality of pachinko balls at a time under a particular condition, as well as some winning sections which are always open and receive only one pachinko ball at a time. The particular condition is that, for example, after a pachinko ball drops into a specific winning section, a plurality of symbols are rotated to be displayed on three display positions arranged horizontally on a display section of the gaming board as if they are three rotation drums of a slot machine so that the three symbols stopped sequentially as time passes match one another or become a predetermined specific combination (hereinbelow, a big-win combination). For example, in a case where symbols indicative of 16 alphabets of A to P are displayed to change dynamically on each of the three display positions, the big-win combinations are combinations in which three display symbols match one another, that is, 16 combinations of "A,A,A" to "P,P,P". The variable winning section has, for example, a cover for covering a rectangular opening provided on the gaming board, and although the cover is usually closed so as to be integral with the gaming board, in a case of the so-called big-win where the above condition is satisfied, the cover is opened so as to allow a number of pachinko balls to drop thereinto in a short period of time. The state where the cover is opened is called a "big-winning state". The variable winning section is set to change into the big winning state intermittently at predetermined times with regard to one big-win. That is, the cover of the variable winning section is closed after a predetermined number of pachinko balls have dropped in or after a lapse of a predetermined time period during one big-winning state so as to release the big-winning state.

In view of a case where pachinko balls happen to drop into the specific winning section while the dynamic-change display section displays symbols changing dynamically, the number of such pachinko balls dropping into the specific winning section, up to 4, is displayed on a winning number display section so as to assure the rights to subsequently have the display of symbols changing dynamically for the number of times by the dynamic-change display section.

Examples of the above-described pachinko game machine are described in Japanese Patent Publications SHO 63-21511, HEI 2-5102, and HEI 2-29350.

By the way, in a conventional pachinko game machine, in order to attract players' interest, arrangement of the specific winning sections on the gaming board is well planned. For example, some pachinko game machines have two or more specific winning sections provided thereon, and some have a special winning section through which pachinko balls move so that they drop into the specific winning section easily thereafter.

Furthermore, in a conventional pachinko game machine, in order to attract players' interest, the symbols which are changed dynamically by the dynamically-change display section are well planned. For example, some pachinko game machines use symbols featuring popular characters or symbols of mahjong tiles and playing cards as well as numbers and alphabetic characters.

However, in any of the pachinko game machines using any of the symbols, there is no difference in that, when a plurality of display positions are in a big-win combination, it is a big-win.

As described above, the conventional pachinko game machines are the same in their basic playing method with different symbols used, although there are various approaches with respect to the arrangement.

Accordingly, an object of the present invention is to provide a pachinko game machine having a card game playing function with which a player can play a game having the atmosphere of a card game.

DISCLOSURE OF THE INVENTION

In order to accomplish the above object, the present invention firstly provides a pachinko game machine having card game playing function, including a specific winning section provided on a gaming board, which is capable of receiving a pachinko ball; a variable winning section provided on the gaming board, which is usually closed and changes into a big-winning state for receiving a plurality of pachinko balls at a time; a symbol determination section for determining a predetermined number of symbols out of plural symbols of playing card when the specific winning section receives a pachinko ball; a symbol display section for displaying each of the symbols determined by the symbol determination section; a winning-combination-and-times storage section for storing therein, with respect to predetermined plural winning combinations in a card playing game, conditions for combinations of symbols for forming the winning combinations and a number of times for the variable winning section to change into the big-winning state in accordance with the winning combination; a winning-combination judging section for judging whether or not the combination of the symbols determined by the symbol determination section forms any of the plural winning-combinations on the basis of the conditions stored in the winning-combination-and-times storage section; and a variable winning section control unit which allows the variable winning section to be in the big-winning state up to the number stored in the winning-combination-and-times storage section in accordance with the winning combination, when the winning-combination judging section judges that one of the winning combinations is formed and after the symbol display section completes displaying the symbols, while it releases the big-winning state when a predetermined number of pachinko balls have dropped into the variable winning section or a predetermined time period lapses with regard to one big-winning state.

Herein, it is preferable that the numbers of times stored in the winning-combination-and-times storage section vary in value for each of the winning combinations and the value is made larger for a stronger winning combination to which a number of times corresponds.

For example, the predetermined plural winning combinations in the card play game, the conditions and numbers for which are stored in the winning-combination and-times storage section, may be the predetermined plural winning combinations in a poker game, and in such a case, the symbol determination section determines five symbols out of the plural symbols of playing cards.

In addition, the present invention secondly provides a pachinko game machine having a card game playing function, including a specific winning section provided on a gaming board, which is capable of receiving a pachinko ball; a variable winning section provided on the gaming board, which is usually closed and changes into a big-winning state for receiving a plurality of pachinko balls at a time; a symbol determination section for determining a predetermined number of symbols out of a plurality of symbols of playing cards when the specific winning section receives a pachinko ball; a symbol display section for displaying each of the symbols determined by the symbol determination section; a winning-combination-and-time period storage section for storing therein, with respect to predetermined plural winning combinations in a card playing game, conditions for combinations of symbols for forming the winning combinations and time periods for the variable winning section to change into the big-winning state in accordance with the winning combinations; a winning-combination judging section for judging whether or not the combination of the symbols determined by the symbol determination section forms any of the plural winning combinations on the basis of the conditions stored in the winning-combination-and-time-period storage section; and a variable winning section control unit which allows the variable winning section to be in the big-winning state up to a predetermined number of times, when the winning combination judging section judges that one of the winning combinations is formed and after the symbol display section completes displaying the symbols, while it releases the big-winning state when a predetermined number of pachinko balls have dropped into the variable winning section with regard to one big-winning state or a predetermined time period stored in the winning-combination-and-time-period storage section lapses with regard to the one winning combination.

Herein, it is preferable that the time periods stored in the winning-combination-and-time-period storage section vary in value for each of the winning combinations and the value is made higher for a stronger winning combination to which a time period corresponds.

For example, the predetermined plural winning combinations in the card play game the conditions and numbers for which are stored in the winning-combination and-time-period storage section may be the predetermined plural winning combinations in a poker game, and in such a case, the symbol determination section determines five symbols out of the plural symbols of playing cards.

According to such a structure, a player can play a game enjoying the atmosphere as if he or she were playing a card game (in the above-described example, a poker game).

Furthermore, since the stronger a winning combination in the card game is, the more times the variable winning section changes into the big-winning state is set, and the more the player will become excited as in a case of playing a card game.

Other structures, operations and effects of the present invention will become clear with the explanations below with reference to the drawings.

BRIEF DESCRIPTION OF THE DRAWINGS

FIG. 2 is an explanatory view showing winning combinations and the number of changes in the pachinko game machine of the first embodiment of the present invention;

FIG. 3 is a structural view of a control unit in the pachinko machine of the first embodiment of the present invention;

FIG. 17 is an explanatory view showing winning combinations and a releasing time periods in a pachinko game machine of a third embodiment of the present invention;

FIG. 23 is an explanatory view showing winning combinations and releasing numbers in a pachinko game machine of a fourth embodiment of the present invention;

FIG. 29 is an explanatory view showing winning combinations and the number of balls to be discharged in a pachinko game machine of a fifth embodiment of the present invention;

FIG. 36 is an explanatory view showing maximum values of the number to form each winning combination in a pachinko game machine of a sixth embodiment of the present invention;

FIG. 39 is an explanatory view showing contents of a table of winning combinations and number of times in the pachinko game machine in the sixth embodiment of the present invention.

DESCRIPTION OF PREFERRED EMBODIMENT

Embodiments of the present invention will be described below with reference to the figures.

Figure 1:
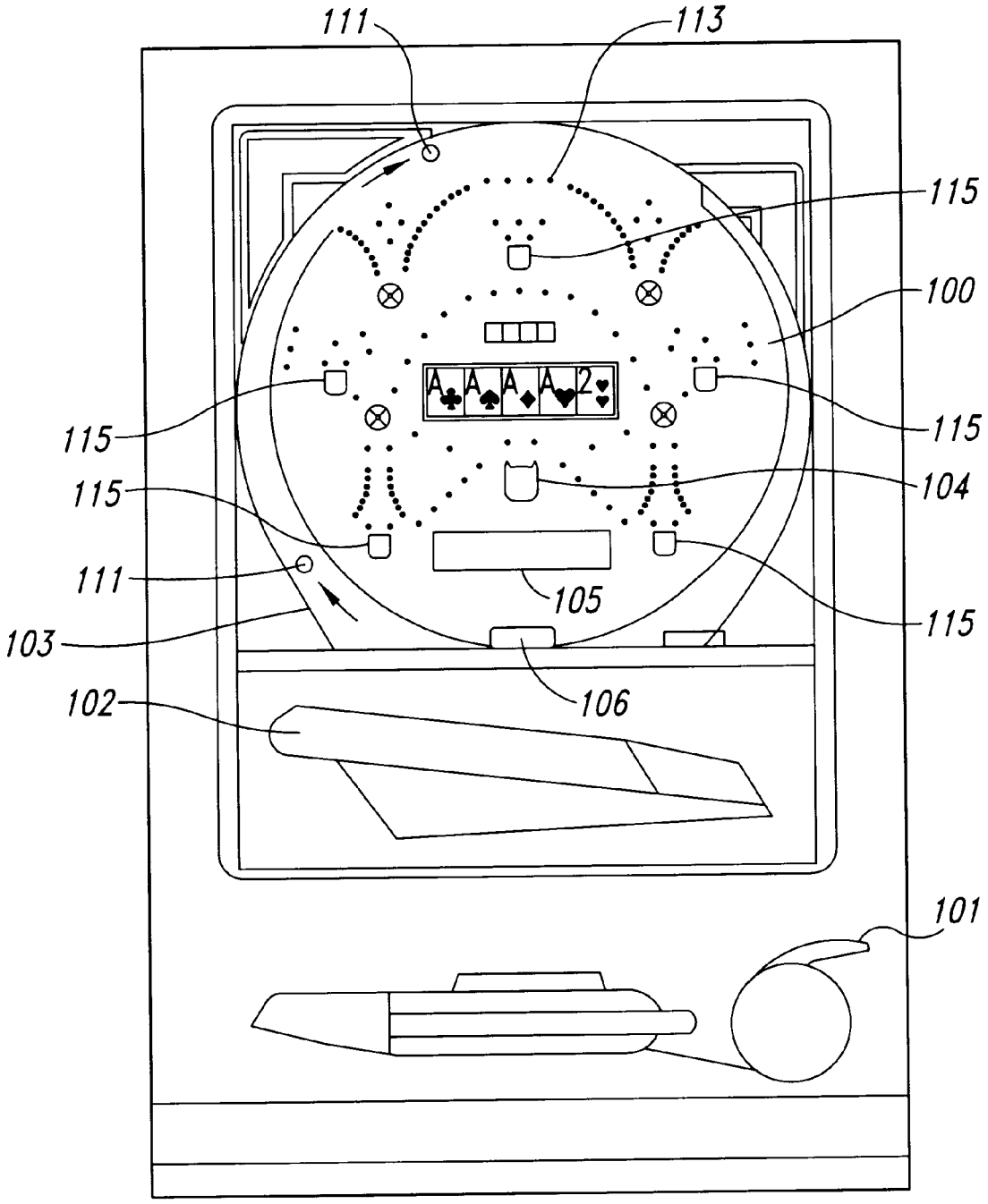
FIG. 1 is a front view of a pachinko game machine of a first embodiment of the present invention.

First, a first embodiment of the present invention will now be described. FIG. 1 is a front view of a pachinko game machine having a card game playing function of the first embodiment. As shown in FIG. 1, the pachinko game machine of the first embodiment includes a gaming board 100 constituting a space for allowing pachinko balls, being game play media, to move, a glass plate (not shown) for covering the gaming board 100 keeping a fixed distance from a surface of the gaming board 100, a shooting mechanism (not shown) provided at a lower portion of the gaming board 100 for projecting a pachinko ball into a space partitioned by the gaming board 100 and the glass plate, and being placed such that the gaming board 100 is oriented in a substantially vertical direction. On a front surface of the pachinko game machine, there are provided a shooting bar 101 which is used by a player to fire a pachinko ball and a tray 102 for storing pachinko balls. The shooting bar 101 constitutes a part of the above described shooting mechanism. That is, the player holds the shooting bar 101 and rotates it to a desired angle so that the pachinko balls stored in the tray 102 are successively fired out one by one with a force corresponding to the rotated angle.

A guide rail 103 is also provided in such a manner as to enclose the gaming board 100. The guide rail 103 guides the pachinko balls hit fired by the shooting bar 101 so as to project the balls toward the upper position in the vertical direction of the gaming board 100. The gaming board 100 is provided with a specific winning section 104 into which a pachinko ball may drop and then be discharged to the backside of the gaming board, indicating winning the game, and a variable winning section 105 into which a plurality of pachinko balls may drop at a time. In addition, the gaming board 100 is provided with a missing ball discharging section 106. The pachinko balls that have dropped into neither the specific winning section 104 nor into the variable winning section 105 finally gather at the lower portion so as to be discharged through the missing ball discharging section 106 out of the gaming board 100. It is designed so that when pachinko balls drop into the specific winning section 104 or the variable winning section 105, a predetermined number of pachinko balls per dropped pachinko ball are discharged into the tray 102.

There are also provided a lot of obstruction nails 113 on the gaming board 100 in such a manner that they project from the gaming board 100 by the length of diameter of a pachinko ball so as to cause a variation in the moving directions of pachinko balls due to frequent collision with the nails. It is possible for a pachinko gaming house to adjust the slope of the nails slightly in order to change the ease with which pachinko balls drop into the specific winning section 104.

In addition, there is provided a card symbol display section 107 on the gaming board 100, where five card symbols out of a plurality of card symbols (playing cards) are updated and displayed respectively on the five display positions when a pachinko ball drops into the specific winning section 104. The card symbol display section 107 sequentially updates and displays the five symbols with a time lag on each of the five display positions. Hereinafter, the symbols displayed on the five display positions by the card symbol display section 107 are referred to as "displayed symbols".

When the displayed symbols on the five display positions correspond to a winning combination of the poker game, the variable winning section 105 is changed into a big-winning state which allows a large number of pachinko balls to drop thereinto at a time, but only the number of times according to the level of the winning combination. Specifically, the variable winning section 105 has a square cover and this cover is closed in such a manner as to be integrated into the gaming board 100 in normal conditions. This section may change into a big-winning state by opening the cover so as to keep an inlet through which a plurality of pachinko balls can drop into at a time. After a predetermined number of pachinko balls have dropped thereinto or a lapse of predetermined period of time in a big-winning state, the variable winning section 105 is designed to be released from the big-winning state by closing the cover.

In view of the case where pachinko balls drop into the specific winning section 104 while the card symbol display section 107 performs updating and displaying of symbols, the number of pachinko balls, up to four, which have been dropped into the specific winning section 104 are displayed on a winning number display section 108, indicating that the right of symbol updating and displaying performed by the card symbol display section 107 is secured.

The card symbol display section 107 may comprise a display unit such as a plasma display or a liquid crystal display.

In addition, there is provided a normal winning section 115 where a pachinko ball drops into and is discharged out of the gaming board 100, indicating a win. Also in the case where a pachinko ball drops into the winning section 115, a predetermined number of pachinko balls are discharged into the tray 102.

Furthermore, the pachinko game machine described in the first embodiment is provided with various decorating lamps, which are not illustrated, and they are actuated while the card symbol display section 107 performs updating and display of the symbols and the variable winning section 105 is in a big-winning state, so that the atmosphere of playing the game is livened up.

Usually, a sound effect (hereinafter referred to as "a first sound effect") is kept playing during the time when the card symbol display section 107 performs updating and display of the symbols, in order to raise the mood of players. During the time the variable winning section 105 is in the big-winning state, a sound effect different from the first sound effect (hereinafter referred to as "a second sound effect") is kept playing to increase the enjoyment of players.

With the pachinko game machine described in the first embodiment, it is possible to play games in the atmosphere of card games, especially a poker game, and when the displayed symbols on the five display positions correspond to a winning combination of the poker game, the number of times the variable winning section 105 changes into the big-winning state is modified in accordance with the winning combination.

Specifically, in the first embodiment, as shown in FIG. 2, when the displayed symbols on the five display positions correspond to the winning combination "two pairs", which indicates that only two symbols with the same number are included, the number of times the variable winning section 105 changes into the big-winning state is set to "2", and when the displayed symbols on the five display positions correspond to the winning combination "three of a kind", which indicates that only three symbols with the same number are included, the number of times the variable winning section 105 changes into the big-winning state is set to "4". In addition, when the displayed symbols on the five display positions correspond to the winning combination "straight" which indicates the displayed symbols on the five display positions have five sequential numbers, the number of times the variable winning section 135 changes into the big-winning state is set to "6", and when the displayed symbols on the five display positions correspond to the winning combination "flush", which indicates the displayed symbols on the five display positions have the same suit, the number of times the variable winning section 105 changes into the big-winning state is set to "8". Furthermore, when the displayed symbols on the five display positions correspond to the winning combination "full house", which indicates the displayed symbols on the five display positions comprise two symbols with the same number and three symbols with another same number, the number of times the variable winning section 105 changes into the big-winning state is set to "10", and when the displayed symbols on the five display positions correspond to the winning combination "four of a kind", which indicates that four symbols with the same number are included, the number of times the variable winning section 105 changes into the big-winning state is set to "16".

When a player starts a game, he or she receives a number of pachinko balls according to the paid cash, and puts the pachinko balls into the tray 102. When the shooting bar 101 is rotated to a desired angle, the pachinko balls stored in the tray 102 are fired out one by one at a force corresponding to the rotating angle, and are guided toward the upper direction of the gaming board 100 along the guide rail 103. At the upper place of the gaming board 100, a pachinko ball starts free falling, and during the course of its fall, it hits against obstruction nails so as to alter the course irregularly. When a pachinko ball drops into the specific winning section 104, a predetermined number (for example seven balls) are discharged into the tray 102 and at the same time, the card symbol display section 107 performs updating and display of the symbols on the five display positions, and the five symbols are sequentially stopped to be displayed with a time lag caused on each of the five display positions. Here it is assumed that the card symbol display section 107 determines the five symbols sequentially in the order of the first display position, the second display position, the third display position, the fourth display position and the fifth display position.

When the card symbol display section 107 completes updating and display of the symbols, and if the displayed symbols on the five display positions correspond to any of the winning combinations, such as "two pairs", "three of a kind", "straight", "flush", "full house" and "four of a kind", the variable winning section 105 changes into the big-winning state by opening the cover the number of times according to the accomplished winning combination (any of the number of times out of "2", "4", "6", "8", "10" and "16", according to the winning combination). As described before, the variable winning section 105 releases the big winning state by closing the cover for one big-winning state, after a drop of a predetermined number of pachinko balls (for example ten) into the variable winning section 105 or after a lapse of the predetermined period of time (for example thirty seconds). Then, a predetermined number of pachinko balls (for example fifteen) for each of the pachinko balls dropped into the variable winning section 105 during one big winning state, that is, during one round, are discharged into the tray 102.

On the other hand, the pachinko balls which have dropped into neither the specific winning section 104 nor the variable winning section 105, drop into the missing ball discharging section 106 and are collected by the pachinko gaming house.

The player may exchange the pachinko balls left on hand for various gifts in accordance with the number of pachinko balls when the game is over.

Next, a control unit for performing the operation of the pachinko game machine of the first embodiment will be described hereinafter, using FIGS. 3 to 11.

The control unit is built in the pachinko game machine, and it is designed to perform the operation of the pachinko game machine.

FIG. 3 is a structural view of the control unit. In FIG. 3, the control unit is indicated as 700, a card symbol display section control unit is indicated as 701, a specific winning section control unit is indicated as 702, a winning number display section control unit is indicated as 703, a variable winning section control unit is indicated as 704, a pachinko ball discharging device is indicated as 705 and an sound effect output device is indicated as 706.

Figure 4:
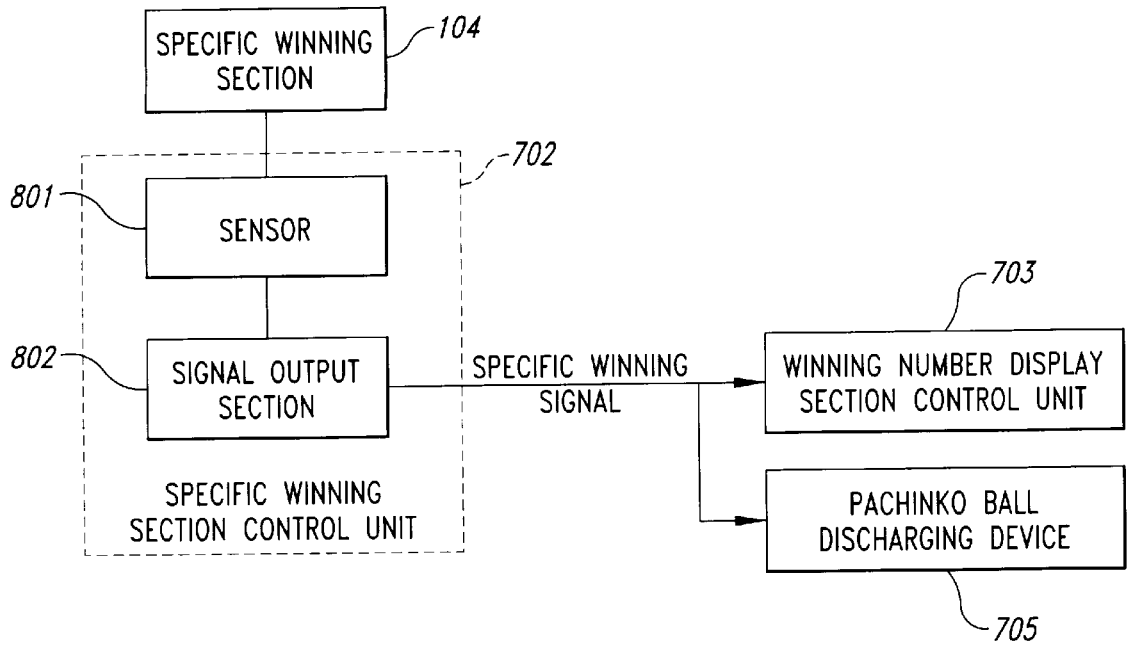
FIG. 4 is an explanatory view showing operation of a specific winning section control unit in the pachinko machine of the first embodiment of the present invention.

Firstly, the specific winning section control unit 702 will be described using FIG. 4. As shown in FIG. 4, in the specific winning section control unit 702, when a sensor 801 detects that a pachinko ball drops into the specific winning section 104, a signal output section 802 outputs a specific winning signal indicating the above fact, to the winning number display section control unit 703 and to the pachinko ball discharging device 705.

Next, the winning number display section control unit 703 will be described with reference to FIG. 5. In the first embodiment, it is designed that the number of pachinko balls, up to four, that have dropped into the specific winning section 104 during display updating, are displayed by lighting up/turning off four lamps prepared in advance on the winning number display section 108.

Figure 5:
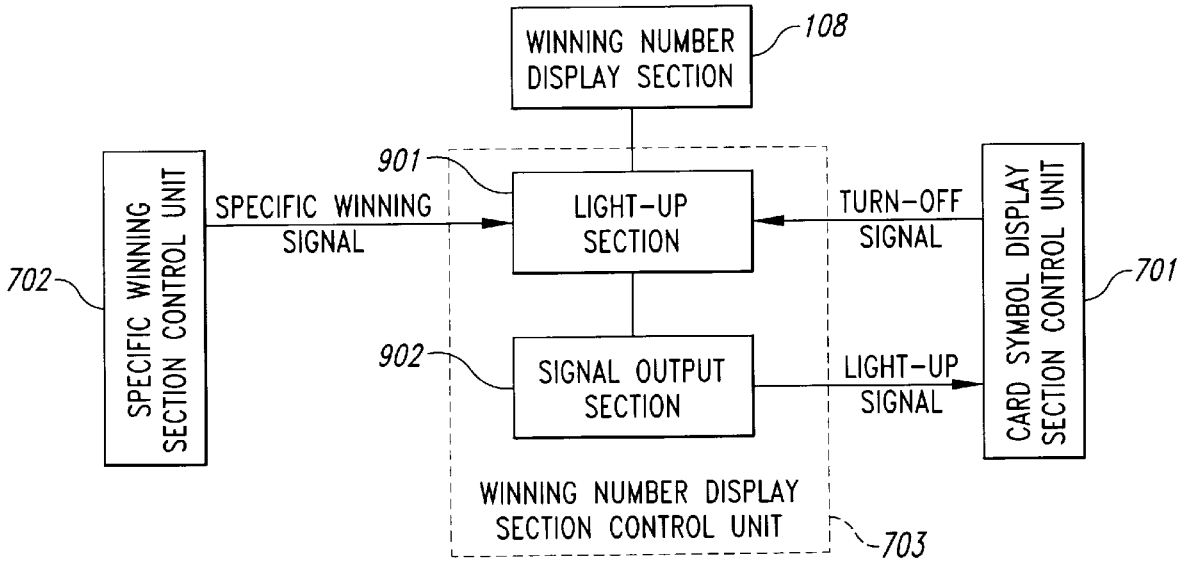
FIG. 5 is an explanatory view showing operation of a winning number display section control unit in the pachinko game machine of the first embodiment of the present invention.

As shown in FIG. 5, the winning number display section control unit 703 comprises a light-up section 901 for lighting up the four lamps and a signal output section 902 for outputting to the card symbol display control unit 701 a light-up signal which indicates that at least one light is lit up. The light-up section 901 lights up the four lamps one by one in the order of the positions every time the specific winning signal is outputted from the specific winning section control unit 702. In addition, every time a turn-off signal as described below is outputted from the card symbol display control section control unit 701, the four lamps go out one by one in the reverse order to how they were lit up. In the case where all of the four lamps are lit up, the light-up section 901 is designed to ignore a specific winning signal even if the specific winning section control unit 702 outputs the signal.

Next, the card symbol display section control unit 701 is described with reference to FIGS. 6 and 7.

Figure 6:
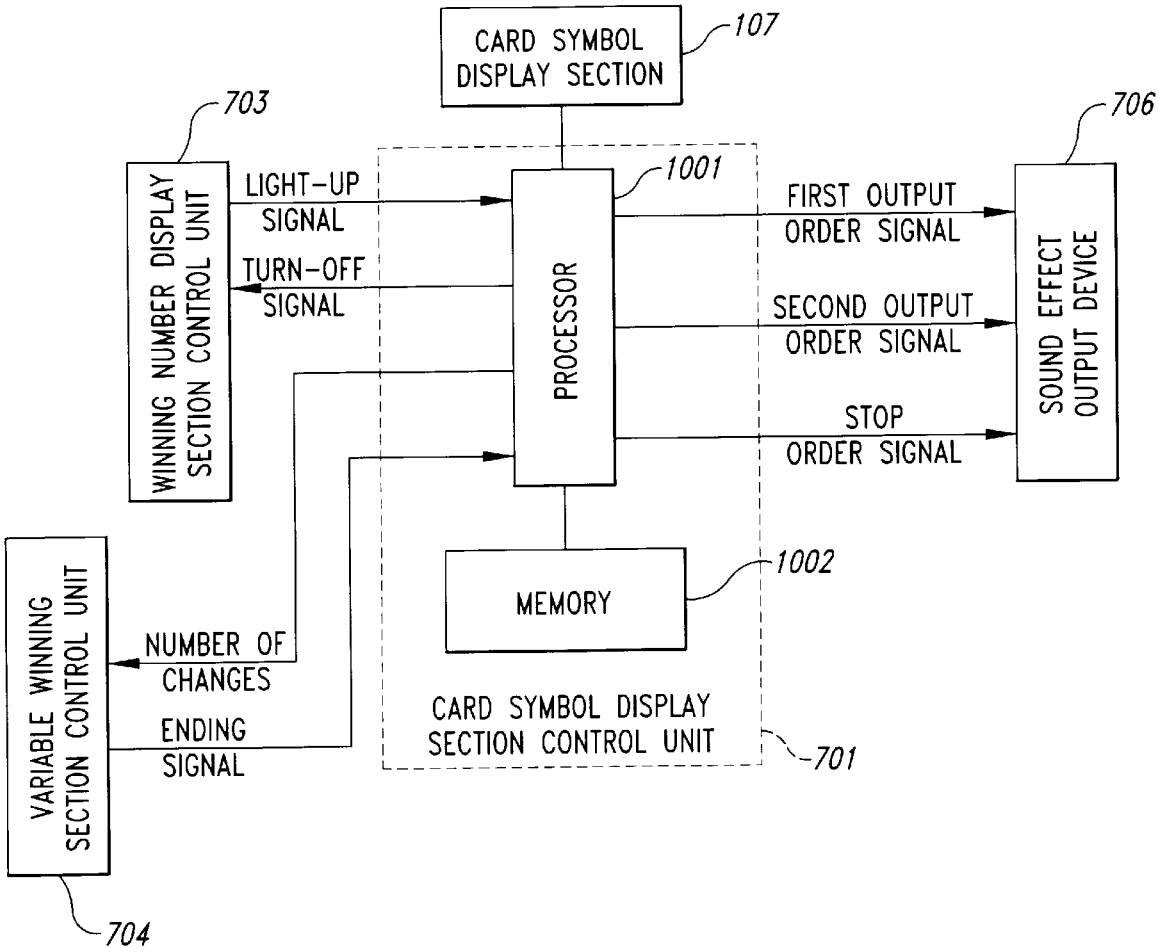
FIG. 6 is an explanatory view showing operation of a card symbol display section control unit in the pachinko game machine of the first embodiment of the present invention.

As shown in FIG. 6, the card symbol display section control unit 701 comprises a processor 1001 and a memory 1002, and the processor 1001 executes programs stored in the memory 1002 to perform the operation. Here, it is assumed that before the five symbols are stopped to be displayed on the five display positions by the card symbol display section 107, a plurality of symbols representing the back of cards are displayed in such a manner that the symbols displayed on each of the five display positions are sequentially and dynamically changed.

Figure 7:
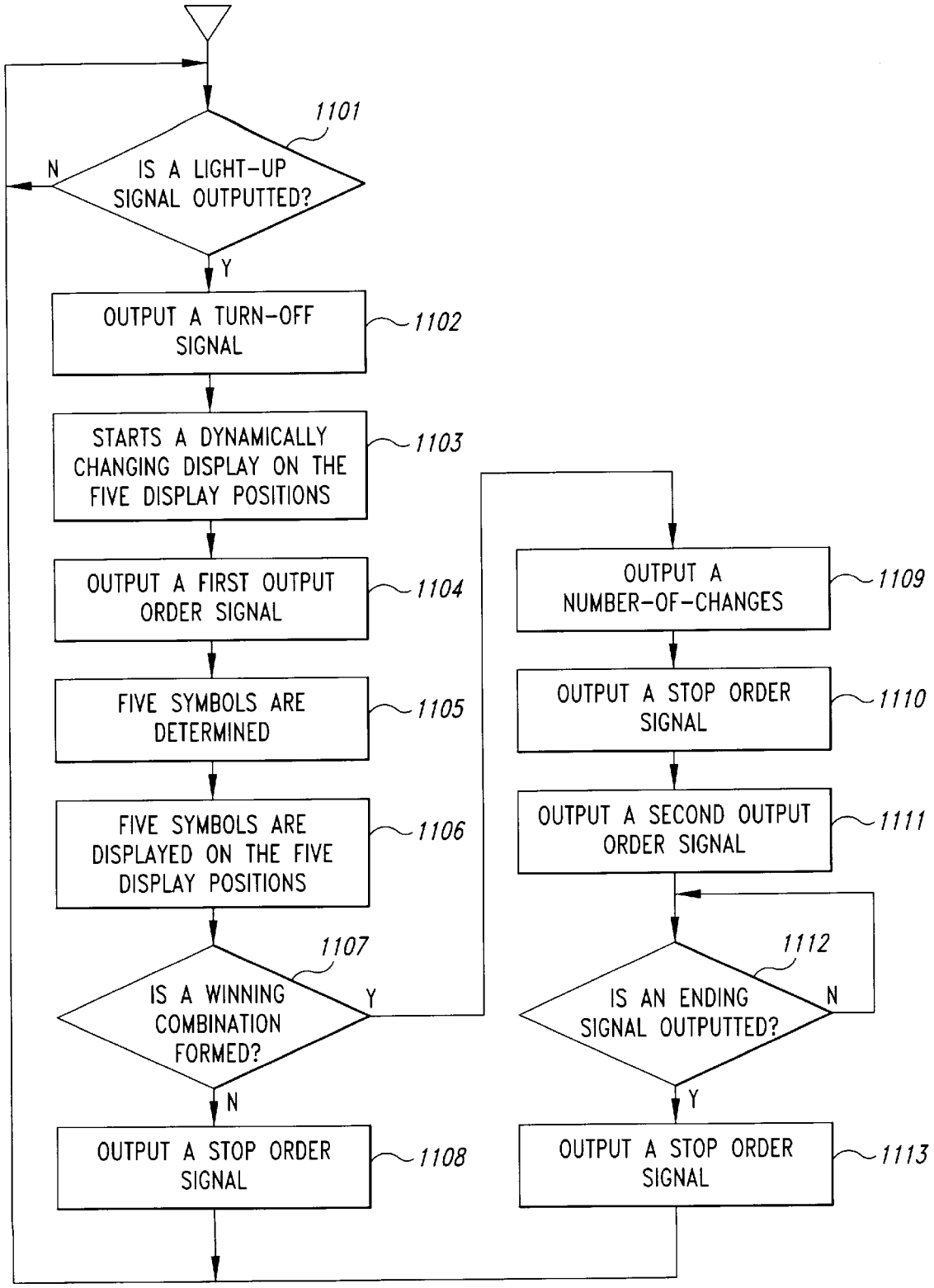
FIG. 7 is a flowchart showing operational flow of a processor included in the card symbol display section control unit in the pachinko game machine of the first embodiment of the present invention.

FIG. 7 is a flowchart showing an operational flow of the processor 1001.

As shown in FIG. 7, in the card symbol display section control unit 701, when a light-up signal is outputted from the winning number display section control unit 703 (step 1101), the processor 1001 firstly outputs to the winning number display section control unit 703 a turn-off signal to let only one lamp go out (step 1102).

Subsequently, the processor 1001 controls the card symbol display section 107 to start a dynamically changing display of the symbols (symbols representing the back of cards) on the five display positions (step 1103), and at the same time, outputs a first output order signal indicating a command to output a first sound effect (step 1104). As a result, the card symbol display section 107 displays a plurality of symbols representing the back of cards respectively on the five display positions in such a manner that the symbols displayed on each of the five display positions are sequentially and dynamically changed, and the sound effect output device 706 outputs the first sound effect as described below.

Subsequently, the processor 1001 determines five symbols of the front sides of cards on the five display positions (step 1105). Specifically, the processor 1001 selects an optional five symbols out of fifty-two symbols each of which represents 4×13=52 cards comprising thirteen numbers ("A (ace)", "2" to "10", "J(Jack)", "Q(Queen)" and "K(King)" for each of four marks ("spade", "heart", "club", "diamond").

Subsequently, the processor 1001 controls the card symbol display section 107 to stop and display the five symbols which have been determined in step 1105 on each of the five display positions (step 1106). Specifically, the processor 1001 controls the card symbol display section 107 so as to stop and display a first symbol out of the five symbols determined in step 1105 on the first display position, after a lapse of time which is predetermined or which have been obtained by a calculation with random numbers. As a result, the card symbol display section 107 ends a dynamically changing display of the symbol (a symbol representing the back of cards) on the first display position and stops and displays on the first display position the first symbol out of the five symbols determined in step 1105.

Similarly, the processor 1001 controls the card symbol display section 107 so as to stop and display the second symbol out of the five symbols determined in step 1105 on the second display position, after a lapse of time which is predetermined or which has been obtained by a calculation with random numbers. As a result, the card symbol display section 107 ends a dynamically changing display of the symbol (a symbol representing the back of cards) on the second display position and stops and displays on the second display position, the second symbol out of the five symbols determined in step 1105.

Similarly, the processor 1001 controls the card symbol display section 107 so as to stop and sequentially display the third, the fourth and the fifth symbols out of the five symbols determined in step 1105 on the third, fourth, and fifth display positions after a lapse of time which is predetermined or which has been obtained by a calculation with random numbers.

Subsequently, the processor 1001 determines whether or not the five symbols determined in step 1105 correspond to any of the winning combinations, "two pairs", "three of a kind", "straight", "flush", "full house" and "four of a kind" (step 1107).

In the case where the five symbols do not correspond to any of the winning combinations, the operation returns to step 1101 after outputting to the sound effect output device 706 a stop order signal indicating a command for stopping the first sound effect which is outputted from the sound effect output device 706.

On the other hand, in the case where the five symbols correspond to one of the winning combinations, a winning-combination-and-times table (FIG. 2) which is stored in the memory 1002 is looked up and the number-of-changes (the number of times the variable winning section 105 changes into the big-winning state) according to the winning combination is outputted to the variable winning section control unit 704 (step 1109).

Specifically, when the winning combination "two pairs" is formed, the processor 1001 outputs the number-of-changes "2" to the variable winning section control unit 704, and when the winning combination "three of a kind" is formed, the processor 1001 outputs the number-of-changes "4" to the variable winning section control unit 704. Similarly, in the case of "straight", it outputs "6", in the case of "flush", it outputs "8", in the case of "full house", it outputs "10" and in the case of "four of a kind", it outputs "16", respectively to the variable winning section control unit 704.

Subsequently, the processor 1001 outputs a stop order signal indicating a command to stop the first sound effect outputted by the sound effect output device 706 (step 1110) and at the same time, a second output order signal indicating a command to output a second sound effect (step 1111). As a result, the variable winning section control unit 704 controls the number of times the variable winning section 105 changes into the big-winning state, so as to correspond to the number-of-changes outputted from the card symbol display section control unit 701, and the sound effect output device 706 outputs the second sound effect.

The processor 1001 then waits for the ending signal described below outputted from the variable winning section control unit 704 (step 1112) so as to output to the sound effect output device 706 the stop order signal indicating a command to stop the second sound effect outputted from the sound effect output device 706 (step 1113), and then the operation returns to step 1101.

Next, the variable winning section control unit 704 will be described with reference to FIGS. 8 and 9.

Figure 8:
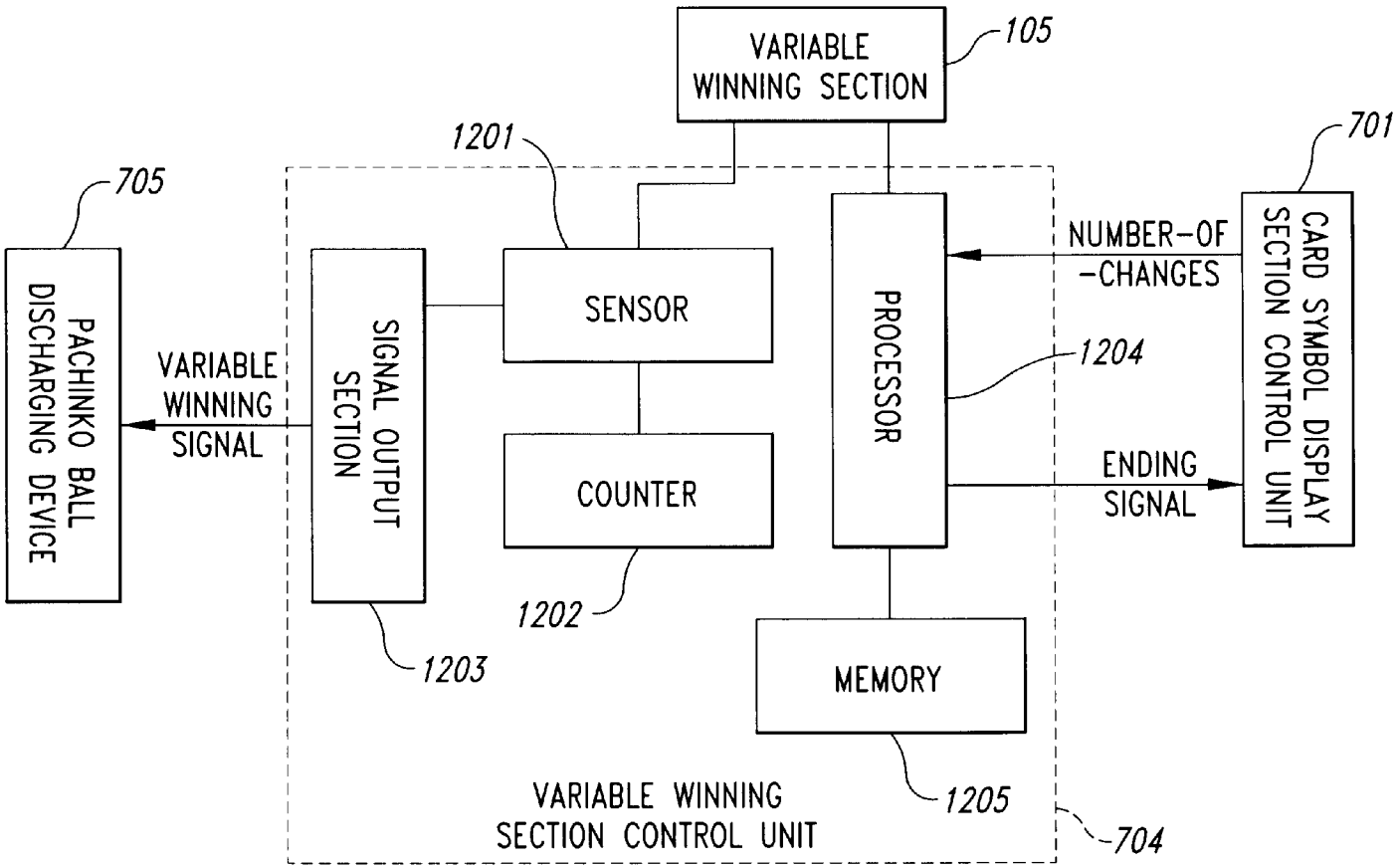
FIG. 8 is an explanatory view showing operation of a variable winning section control unit in the pachinko game machine of the first embodiment of the present invention.

As shown in FIG. 8, in the variable winning section control unit 704, every time the sensor 1201 detects that a pachinko ball drops into the variable winning section 105, the counter 1202 increments the counted value by "1", and the signal output section 1203 outputs to the pachinko ball discharging device 705 a variable winning signal indicating that a pachinko ball has dropped into the variable winning section 105.

Furthermore, the variable winning section control unit 704 comprises a processor 1204 and a memory 1205, and the processor 1204 executes the programs stored in the memory 1205 to perform the operation.

Figure 9:
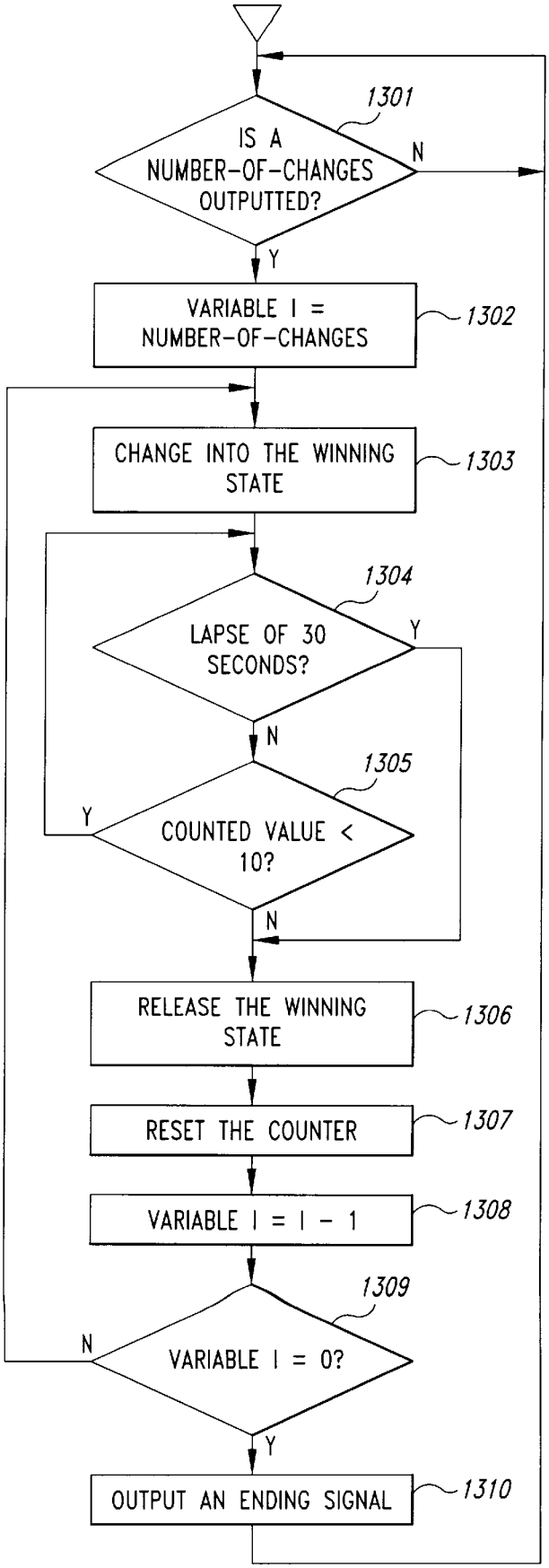
FIG. 9 is a flowchart showing an operational flow of a processor included in the variable winning section control unit in the pachinko game machine of the first embodiment of the present invention.

FIG. 9 is a flowchart showing the operational flow of the processor 1204.

As shown in FIG. 9, in the variable winning section control unit 704, when the number-of-changes is outputted from the card symbol display section control unit 701 (step 1301), the processor 1204 sets the number-of-changes as a variable I (step 1302), and then controls the variable winning section 105 to change into the big-winning state by opening the cover (step 1303). As a result, the variable winning section 105 changes into the big-winning state by opening the cover, and the number of pachinko balls which have dropped into the variable winning section 105 while the cover is kept open by the variable winning section, is counted by the counter 1202.

Subsequently, after a lapse of thirty seconds (step 1304) or when the counted value by the counter 1202 becomes "10" before a lapse of thirty seconds (step 1305), the processor 1204 controls the variable winning section 105 to release the big-winning state by closing the cover (step 1306). As a result, the variable winning section 105 releases the big-winning state by closing the cover.

Subsequently, the processor 1204 resets the counted value of the counter 1202 (step 1307) and at the same time, subtracts "1" from the variable I (step 1308).

As a result of subtraction of "1" from the variable I, it is determined whether or not the value of the variable I becomes "0" (step 1309). In the case where it has not become "0", the operation returns to step 1303, and when it becomes "0", the processor 1204 outputs an ending signal indicating that all of the changes into the big-winning state of the variable winning section 105 have been completed (step 1310).

Figure 10:
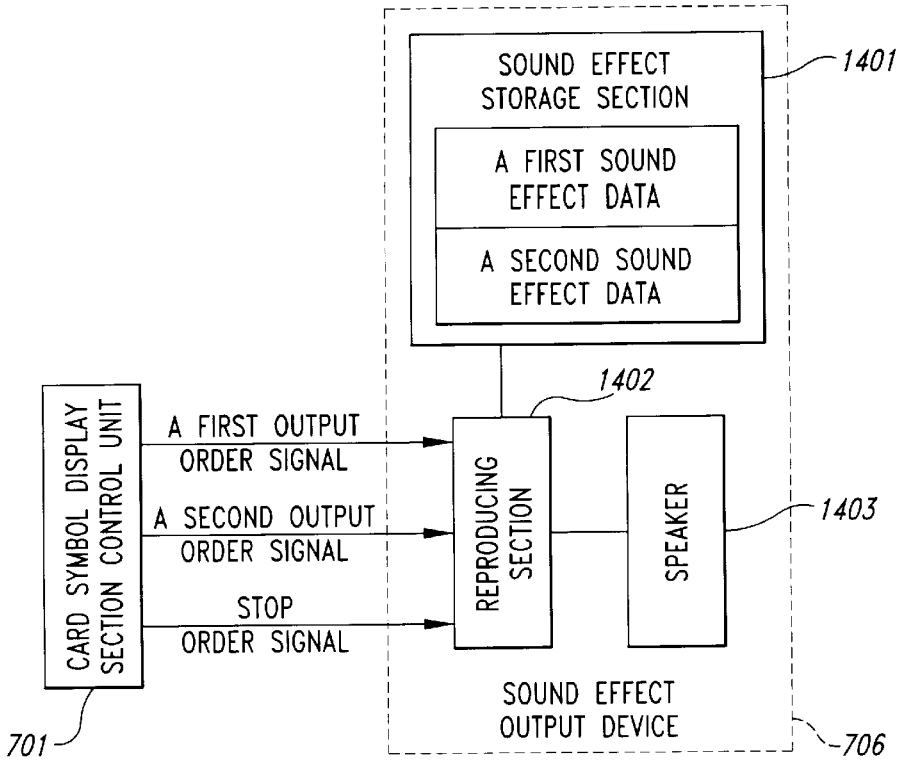
FIG. 10 is an explanatory view showing operation of an sound effect output device in the pachinko game machine of the first embodiment of the present invention.

Next, the sound effect output device 706 will be described with reference to FIG. 10. As shown in FIG. 10, the sound effect output device 706 comprises a sound effect storage section 1401 where a first sound effect data representing a first sound effect and a second sound effect data representing a second sound effect are stored, a reproducing section 1402 where a sound effect is reproduced by reading out any of the sound effect data stored in the sound effect storage section 1401, and a speaker 1403 for outputting the sound effect reproduced by the reproducing section 1402.

Specifically, when a first output order signal is outputted from the card symbol display section control unit 701, the reproducing section 1402 reads out the first sound effect data from the sound effect storage section 1401, reproduces the first sound effect and outputs it from the speaker 1403 until the stop order signal is outputted from the card symbol display section control unit 701. In addition, when a second output order signal is outputted from the card symbol display section control unit 701, the reproducing section 1402 reads out the second sound effect data from the sound effect storage section 1401, reproduces the second sound effect and outputs it from the speaker 1403 until a stop order signal is outputted from the card symbol display section control unit 701.

It is described here that the sound effect outputted by the sound effect output device 706 may be an electrical sound. However, it may be a sound effect which is recorded on a tape in advance. In the first embodiment, there are prepared two kinds of sound effects such as the first sound effect and the second sound effect. However, it may be possible to output different sound effects in each of the corresponding winning combinations. This may be accomplished in such a way that the card symbol display section control unit 701 outputs to the sound effect output device 706 an output order signal according to a winning combination, and the sound effect output device 706 outputs the sound effect corresponding to the output order signal.

Next, the pachinko ball discharging device 705 will be described with reference to FIG. 11.

Figure 11:
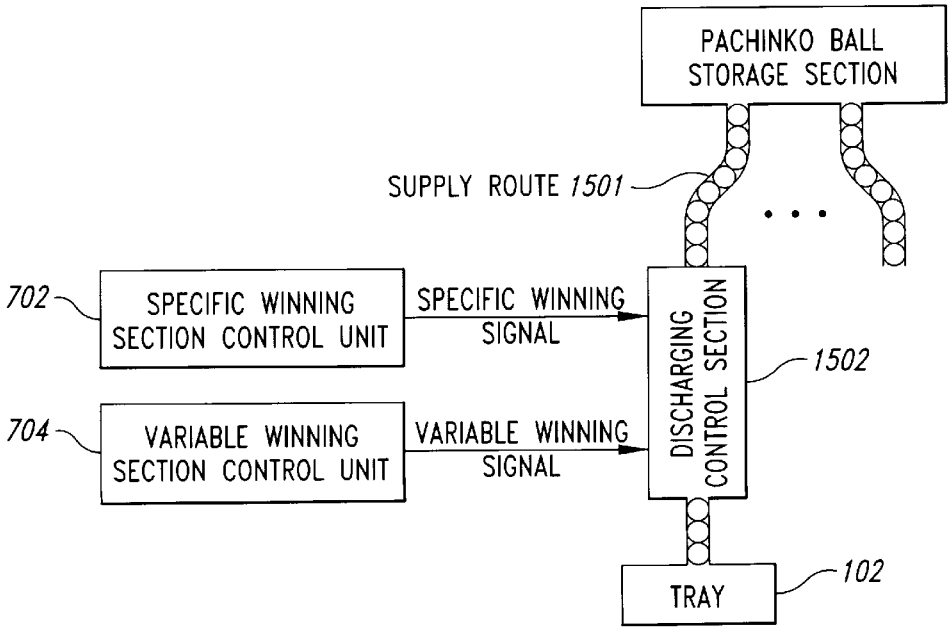
FIG. 11 is an explanatory view showing operation of a pachinko ball discharging device in the pachinko game machine of the first embodiment of the present invention.

As shown in FIG. 11, the pachinko ball discharging device 705 comprises a supply route 1501 which connects the pachinko ball storage section where a large number of pachinko balls are stored with the tray 102 of the pachinko game machine, and a discharging control section 1502 which discharges pachinko balls into the tray 102 by opening and shutting down the supply route 1501.

The supply route 1501 is in the form of a tube whose diameter corresponds to that of a pachinko ball, and pachinko balls are put one by one in a line inside the part of the supply route 1501 between the pachinko ball storage section and the discharging control section 1502.

The discharging control section 1502 usually shuts down the supply route 1501. When a specific winning signal is outputted from the specific winning section control unit 702, seven pachinko balls are discharged into the tray 102, and when a variable winning signal is outputted from the variable winning section control unit 704, fifteen pachinko balls are discharged into the tray 102. In other words, the discharging control unit 1502 operates in such a manner that it opens the supply route 1501 when pachinko balls are to be discharged, counts the number of the pachinko balls which have passed while the supply route 1501 is open, and shuts down the supply route 1501 again after the corresponding number of pachinko balls have passed.

The pachinko balls which have dropped into the missing ball discharging section 106 of a plurality of pachinko game machines are collected into the pachinko ball storage section via a discharging route (not shown) connecting each of the missing ball discharging sections 106 with the pachinko ball storage section.

Figure 12:
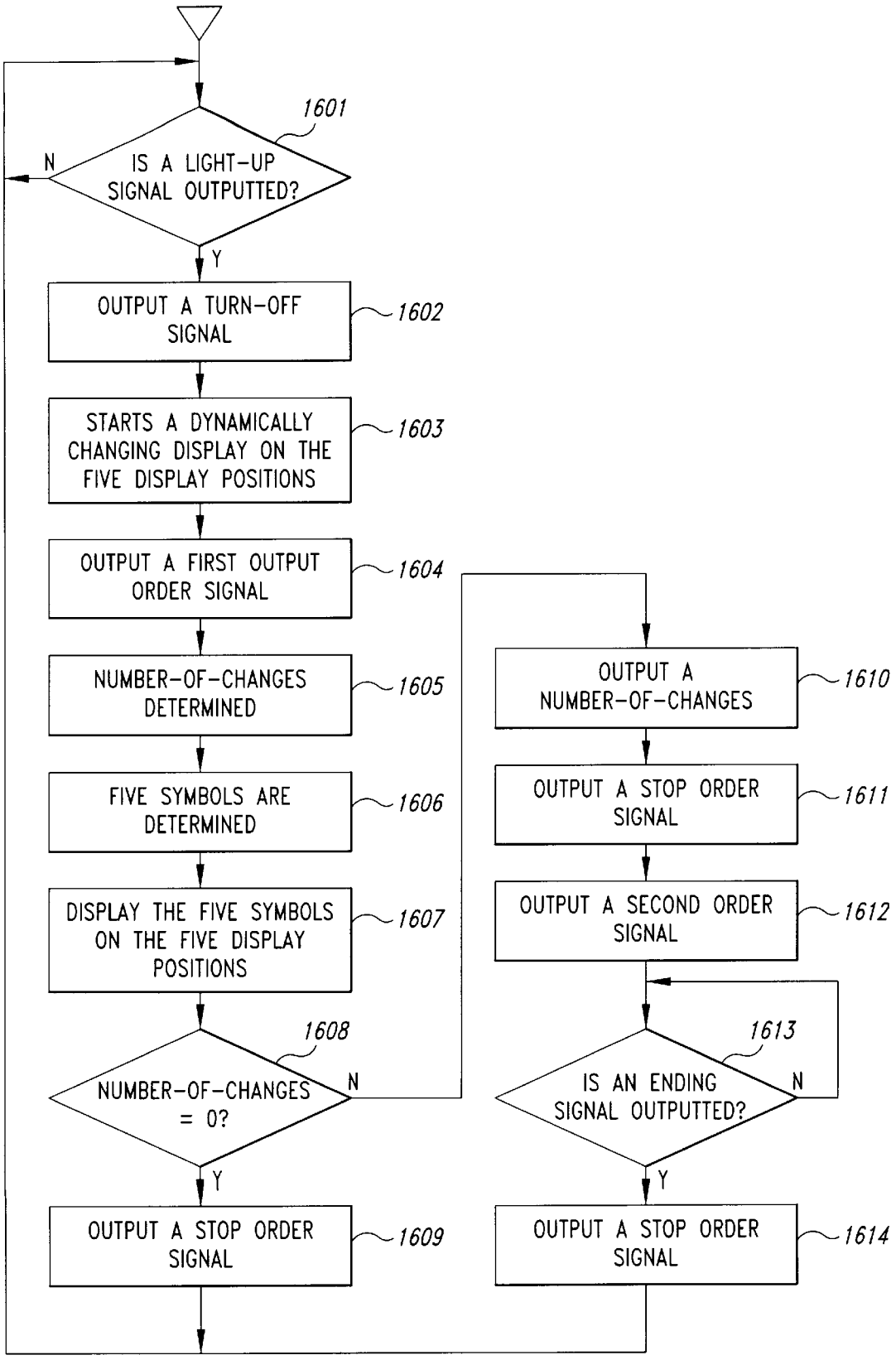
FIG. 12 is a flowchart showing another operational flow of the processor included in the card symbol display section control unit in the pachinko game machine of the first embodiment of the present invention.

By the way, in the aforementioned operational example of a pachinko game machine, it has been described that the card symbol display section control unit 701 determines five symbols and the number-of-changes are decided according to the winning combination corresponding to the five symbols. Conversely, it is possible to determine the number-of-changes in advance and then decide five symbols according to the determined number of times. Hereinafter, such an example of the operation will be described with reference to FIG. 12. FIG. 12 is a flowchart showing the operational flow of the processor 1001.

In such a pachinko game machine, only the operation of the card symbol display section control unit 701 is different from the aforementioned example. Similarly to the aforementioned operational example, it is assumed that the card symbol display section 107 displays a plurality of symbols representing the back of cards in such a manner that the symbols displayed on each of the five display positions are sequentially and dynamically changed before the card symbol display section 107 stops the five symbols to be displayed on the five display positions.

As shown in FIG. 12, in the card symbol display section control unit 701, in the case where a light-up signal is outputted from the winning number display section control unit 703 (step 1601). the processor 1001 outputs to the winning number display section control unit 703 a turn-off signal to let only one lamp go off (step 1602).

Subsequently, the processor 1001 controls the card symbol display section 107 to start a dynamically changing display of the symbols (representing the back of cards) on the five display positions (step 1603), and at the same time, outputs a first output order signal indicating a command to output a first sound effect to the sound effect output device 706 (step 1604).

Subsequently, the processor 1001 looks up the winning-combination-and-times table stored in the memory 1002, and determines a number-of-changes including "0" (step 1605). Specifically, the processor 1001 determines a number-of-changes from among "0", "2", "4", "6", "8", "10", and "16". At this stage, in order to assign weights to each of the number-of-changes, it should be determined in accordance with a predetermined probability value with respect to each of the numbers-of-change. For example, in order to make the total number of pachinko balls discharged to a player from the gaming machine of the first embodiment be approximately the same as that from a conventional pachinko game machine, the probability value for determining the number-of-changes as "16" is 0.02% and that for determining the number-of-changes as "10" is 0.03%. In addition, the probability value for determining the number-of-changes as "8" is 0.04% and that for determining the number-of-changes as "6" is 0.05%. Moreover, the probability value for determining the number-of-changes as "4" is 0.08%, that for determining the number-of-changes as "2" is 0.15% and that for determining the number-of-changes as "0" is 99.63%.

Subsequently, the processor 1001 looks up the winning-combination-and-times table stored in the memory 1002, and determines five symbols out of a plurality of card symbols in accordance with the number-of-changes which has been determined in step 1605 (step 1606). Specifically, the processor 1001 determines symbols out of fifty-two symbols representing fifty-two cards respectively, which form the winning combination corresponding to the number-of-changes. In other words, in the case where the number-of-changes is "16", five symbols which form the winning combination of "four of a kind" are determined. Similarly, five symbols which form other winning combinations are determined respectively in such a manner that in the case where the number-of-changes is "10", it is "full house", in the case where the number-of-changes is "8", it is "flush", in the case where the number-of-changes is "6", it is "straight", in the case where the number-of-changes is "4", it is "three of a kind", and in the case where the number-of-changes is "2", it is "two pairs". In the case where the number-of-changes is "0", five symbols which do not form any of the winning combinations are determined.

Subsequently, the processor 1001 controls the card symbol display section 107 so as to display the five symbols determined in step 1606 on each of the five display positions (step 1607). The way of displaying those symbols is the same as described above.

Subsequently, the processor 1001 determines whether or not the number-of-changes which has been decided in step 1605 is "0" (step 1608), and in the case where it is "0", the processor 1001 outputs a stop order signal to the sound effect output device 706, indicating a command to stop the first sound effect outputted from the sound effect output device 706 (step 1609), and then the operation returns to step 1601.

In the case where the number-of-changes which has been decided in step 1605 is other than "0", the processor 1001 outputs the number-of-changes to the variable winning section control unit 704 (step 1610).

Subsequently, the processor 1001 outputs to the sound effect output device 706 a stop order signal indicating a command to stop the first sound effect outputted by the sound effect output device 706 (step 1611), and at the same time, a second output order signal indicating a command to output the second sound effect to the sound effect output device 706 (step 1612). As a result, the variable winning section control unit 704, as described above, controls the number of times the variable winning section 105 changes into the big-winning state so as to be same as the number-of-changes outputted from the card symbol display section control unit 701, and the sound effect output device 706 outputs the second sound effect as described above.

The processor 1001 then waits for an ending signal outputted from the variable winning section control unit 704 (step 1613), so as to output to the sound effect output device 706 a stop order signal indicating a command to store the second sound effect outputted from the sound effect output device 706 (step 1614), and then the operation returns to step 1601.

As described above, according to the gaming machine of the first embodiment, the number of times the variable winning section 105 changes into the big-winning state varies in accordance with the strengths (levels) of the winning combinations of the poker game, to which the displayed symbols on the five display positions correspond, the stronger a winning combination is, the greater the level of enjoyment of a player, as in a case of playing poker game. Therefore, the player can play the game enjoying the atmosphere of playing a poker game.

In the above first embodiment, when the card symbol display section control unit 701 performs one of the operations, the variable winning section 105 changes into the big-winning state, without exception, with the number-of-changes corresponding to a winning combination of the poker game. On the other hand, a different embodiment may operate thus; when the display symbols on the five display positions form the winning combination "four of a kind", it is regarded as "a biggest win", which is the ultimate aim in playing a conventional pachinko game machine. In the case where the displayed symbols on the five display positions form one of the winning combinations other than "four of a kind" before the variable winning section 105 starts changing into the big-winning state 16 times at the time of the biggest win, the variable winning section 105 changes into the big winning state with the number-of-changes corresponding to those winning combinations, and then a total number of such numbers-of-change are counted, so as to be subtracted from "16" when the biggest win is actually accomplished so that the variable winning section 105 changes into the big-winning state only the resultant number of times.

Hereinafter, the embodiment described above will be described as a second embodiment with FIGS. 13 to 16.

Figure 13:
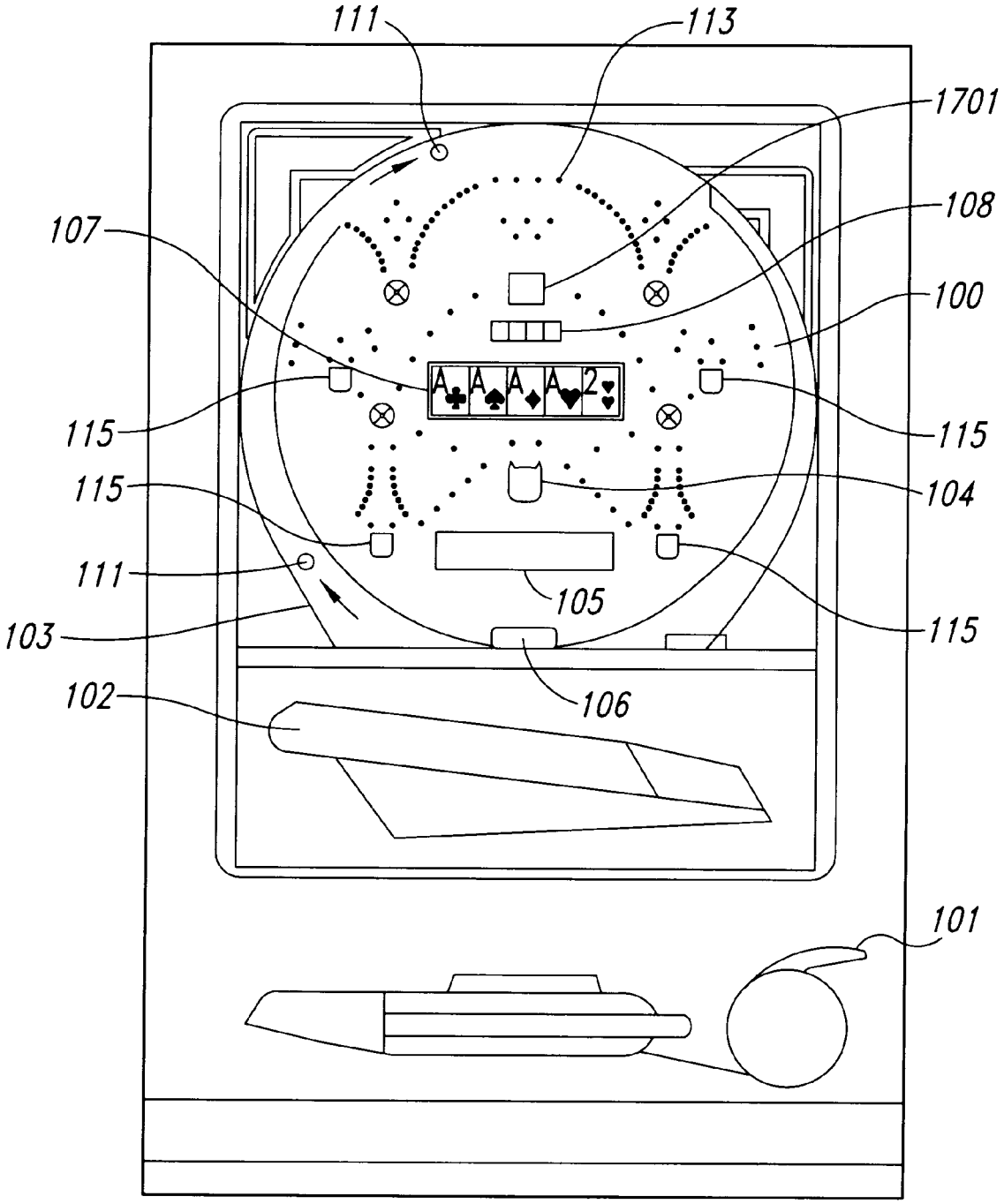
FIG. 13 is a front view of a pachinko game machine of a second embodiment of the present invention.

FIG. 13 is a front view of a pachinko game machine of the second embodiment. As shown in FIG. 13, on the pachinko game machine of the second embodiment, there is provided a number-of-changes display section 1701 indicating the total value of the numbers-of-change in addition to the components shown in FIG. 1. Other than this portion, the external view of FIG. 13 is same as that of FIG. 1.

Specifically, the number-of-changes display section 1701 displays a total value of the numbers-of-change in accordance with the winning combinations besides "four of a kind" to which the displayed symbols on the five display positions correspond, from the time when the displayed symbols on the five display positions form one of the winning combinations besides "four of a kind" until the time when they form the winning combination "four of a kind" thereafter. Since it may be possible that the total value reaches "16" before the five symbols form "four of a kind", it is designed here that the number-of-changes display section 1701 resets the total value to be displayed to "0", when it exceeds "16".

Figure 14:
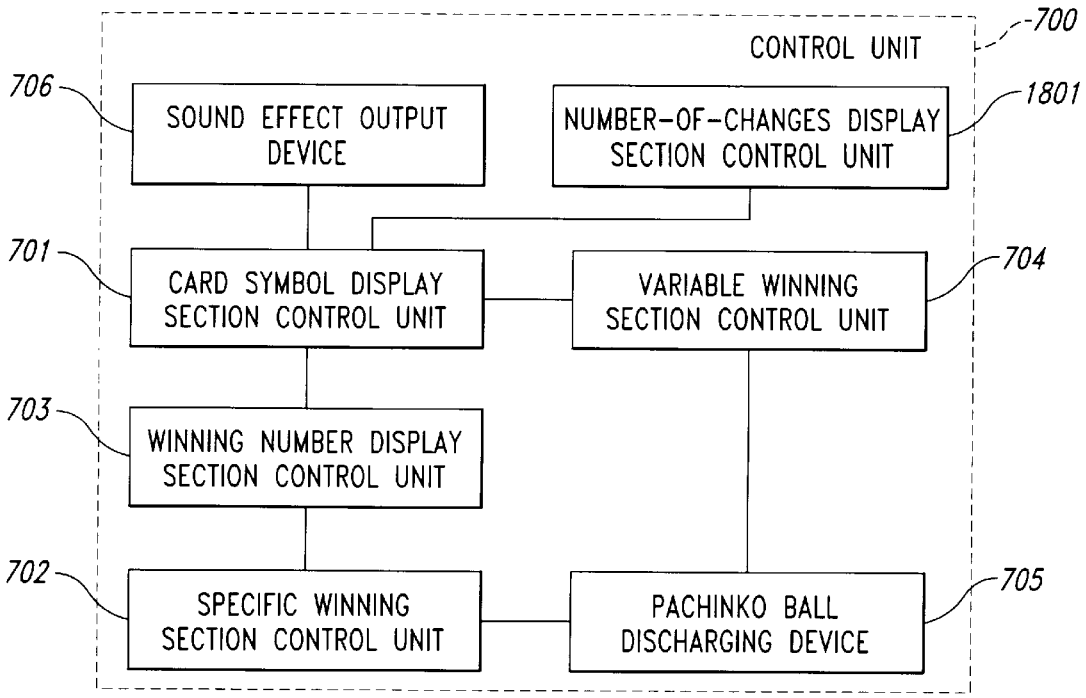
FIG. 14 is a structural view of a control unit in the pachinko game machine of the second embodiment of the present invention.

FIG. 14 is a structural view of a control unit for performing the operation of the pachinko game machine of the second embodiment. As shown in FIG. 14, the control unit 700 in the pachinko game machine of the second embodiment comprises a number-of-changes display section control unit 1801 in addition to the components shown in FIG. 3. In the second embodiment, when the card symbol display section control unit 701 outputs the number-of-changes to the variable winning section control unit 704, it is also outputted to the number-of-changes display section control unit 1801.

Hereinafter, the number-of-changes display section control unit 1801 will be described with reference to FIGS. 15 and 16.

Figure 15:
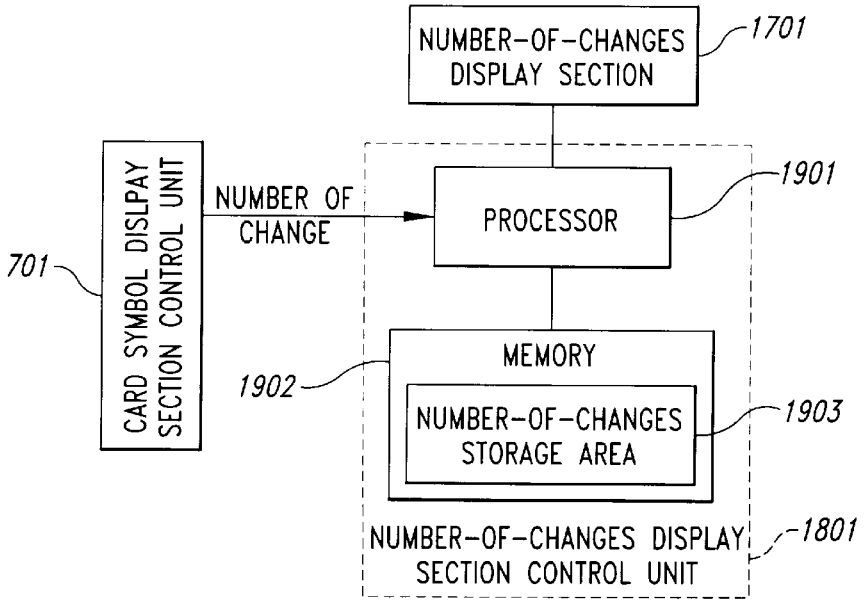
FIG. 15 is an explanatory view showing operation of a number-of-changes display section control unit in the pachinko game machine of the second embodiment of the present invention.

As shown in FIG. 15, the number-of-changes display section control unit 1801 comprises a processor 1901 and a memory 1902, and the processor 1901 executes the programs stored in the memory 1902 to perform the operation. Furthermore, in the memory 1902, a number-of-changes storage area 1903 for storing the total value of the numbers-of-change is allocated.

Figure 16:
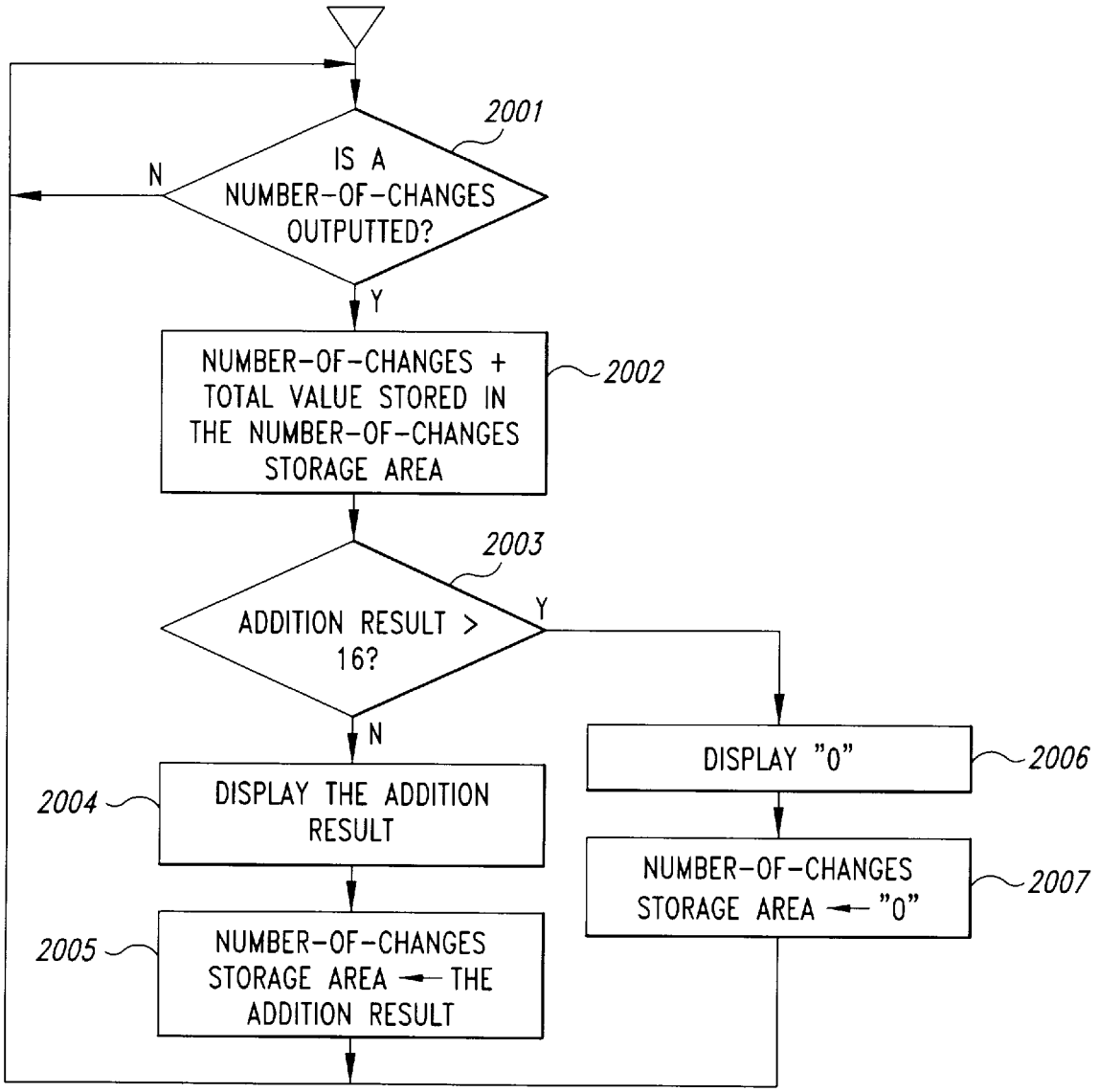
FIG. 16 is a flowchart showing an operational flow of a processor included in the number-of-changes display section control unit in the pachinko game machine of the second embodiment of the present invention.

FIG. 16 is a flowchart showing the operational flow of the processor 1901.

As shown in FIG. 16, in the number-of-changes display section control unit 1801, when a number-of-changes is outputted from the card symbol display section control unit 701 (step 2001), the processor 1901 adds the number-of-changes to the total value stored in the number-of-changes storage area 1903 (step 2002), and determines whether or not the resultant value exceeds "16" (step 2003). If it does not exceed "16", the processor 1901 controls the number-of-changes display section 1701 so as to display the resultant value (step 2004) and at the same time, stores the resultant value in the number-of-changes storage area 1903 (step 2005). At this time, it is possible for the number-of-changes display section 1701 to display the total value from the currently displayed total value of the number-of-changes up to the resultant value in such a manner as counting up by "1".

If the resultant value exceeds "16", the processor 1901 controls the number-of-changes display section 1701 so as to display "0" (step 2006), and at the same time, stores "0" in the number-of-changes storage area 1903 (step 2007). At this time, it is possible for the number-of-changes display section 1701 to display the total value in such a manner as counting up by "1" from the currently displayed number-of-changes up to "16", and to display "0" after "16" is displayed.

As a way of example, it is assumed that a player starts the game at the time when the total value of numbers-of-change displayed on the number-of-changes display section 1701 is "0", and he or she has obtained the displayed symbols on the five display positions corresponding to the winning combinations in a sequence of "three of a kind", "two pairs" and "four of a kind".

In the above case, at first when the winning combination "three of a kind" is formed, the variable winning section 105 changes into the big-winning state only four times, and the number-of-changes display section 1701 displays "4". Subsequently when the winning combination "two pairs" is formed, the variable winning section 105 changes into the big-winning state only two times, and the number-of-changes display section 1701 displays "6 (=4+2)". Thereafter, when the winning combination "four of a kind" is obtained, the number-of times the variable winning section 105 changes into the big-winning state becomes "10

(=16−6)", and the total value of the number-of-changes displayed by the number-of-changes display section 1701 becomes "0".

As another example, it is assumed that a player starts the game at the time when the total value of numbers-of-change displayed on the number-of-changes display section 1701 is "0", and he or she has obtained the displayed symbols on the five display positions corresponding to the winning combinations in a sequence of "three of a kind", "flush" and "straight".

In the above case, at first when the winning combination "three of a kind" is formed, the variable winning section 105 changes into the big-winning state only four times, and the number-of-changes display section 1701 displays "4". Subsequently when the winning combination "flush" is obtained, the variable winning section 105 changes into the big-winning state only eight times, and the number-of-changes display section 1701 displays "12 (=4+8)". Thereafter, when the winning combination "straight" is formed, the variable winning section 105 changes into the big-winning state only six times, and the total value of the number-of-changes displayed by the number-of-changes display section 1701 becomes "0".

In the pachinko game machine of the second embodiment, when the displayed symbols on the five display positions form the winning combination "four of a kind", it is designed that the variable winning section 105 changes into the big-winning state only the number of times which is obtained by subtracting from "16", that is a number-of-changes corresponding to "four of a kind", the total value of numbers-of-change corresponding to the winning combinations other than "four of a kind" formed so far. Therefore, in the operational example where the card symbol display section control unit 701 determines the number-of-changes in advance, it is possible to keep the total number of pachinko balls to be discharged to a player almost the same as the number to be discharged from a conventional pachinko game machine, even if the probability value for determining the number-of-changes as other than "0" is made larger.

Next, the third embodiment of the present invention will be described.

The front view of the pachinko game machine having a game card playing function of the third embodiment is the same as the one shown in FIG. 1. The pachinko game machine of the third embodiment is designed to change the period of time which must elapse before the variable winning section 105 is triggered to release a big-winning state in accordance with a winning combination of the poker game to which the displayed symbols on the five display positions correspond.

Specifically, in the third embodiment, as shown in FIG. 17, when the displayed symbols on the five display positions correspond to the winning combination "two pairs", "4 (seconds)" is set as a time period to trigger releasing of the big-winning state by the variable winning section 105, and when the displayed symbols on the five display positions correspond to the winning combination "three of a kind", "8 (seconds)" is set as a time period to trigger releasing of the big-winning state by the variable winning section 105. Similarly, the time period to trigger releasing of the big-winning state is set as "12 (seconds)" in the case of "straight", it is set as "16 (seconds)" in the case of "flush", it is set as "20 (seconds)" in the case of "full house" and it is set as "30 (seconds)" in the case of "four of a kind".

When a pachinko ball drops into the specific winning position 104 and then the card symbol display section 107 performs updating and displaying of the five symbols, the variable winning section 105 changes into the big-winning state by opening the cover only the predetermined number of times (for example, 16 times) in the case where the displayed symbols on the five display positions correspond to one of the winning combinations "two pairs", "three of a kind", "straight", "full house" and "four of a kind". For one big-winning state, the variable winning section 105 closes the over to release the big-winning state after a predetermined number of pachinko balls have dropped in (for example, 10) or after a lapse of time in accordance with the formed inning combination (one of the periods of time in seconds, namely "4", "8", "12", "16", "20" and "30" in accordance with the winning combination).

Next, there will be described a control unit for performing the operation of the pachinko game machine of the third embodiment. The structural view of the control unit of the third embodiment is the same as the one shown in FIG. 3. In the pachinko game machine of the third embodiment, only the operations of the card symbol display section control unit 701 and of the variable winning section control unit 704 are different from the first embodiment.

Firstly, the card symbol display section control unit 701 will be described with reference to FIGS. 18 and 19.

Figure 18:
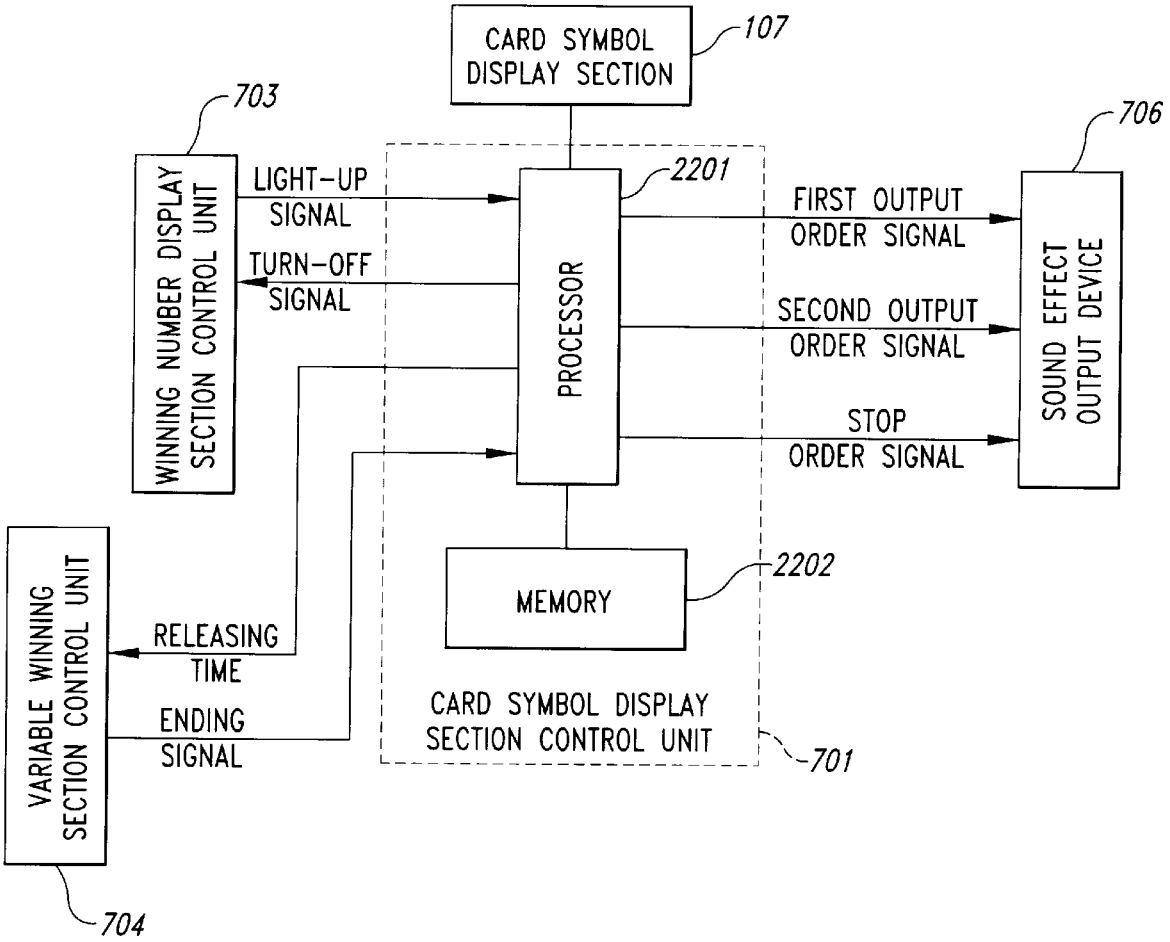
FIG. 18 is an explanatory view showing operation of a card symbol display section control unit in the pachinko game machine of the third embodiment of the present invention.

As shown in FIG. 18, the card symbol display section control unit 701 comprises a processor 2201 and a memory 2202, and the processor 2201 executes programs stored in the memory 2202 to perform the operation. Here, similarly to the first embodiment, it is designed that before the five symbols are stopped to be displayed on the five display positions, the card symbol display section 107 displays a plurality of symbols representing the back of cards in such a manner that the symbols displayed on each of the five display positions are sequentially and dynamically changed.

Figure 19:
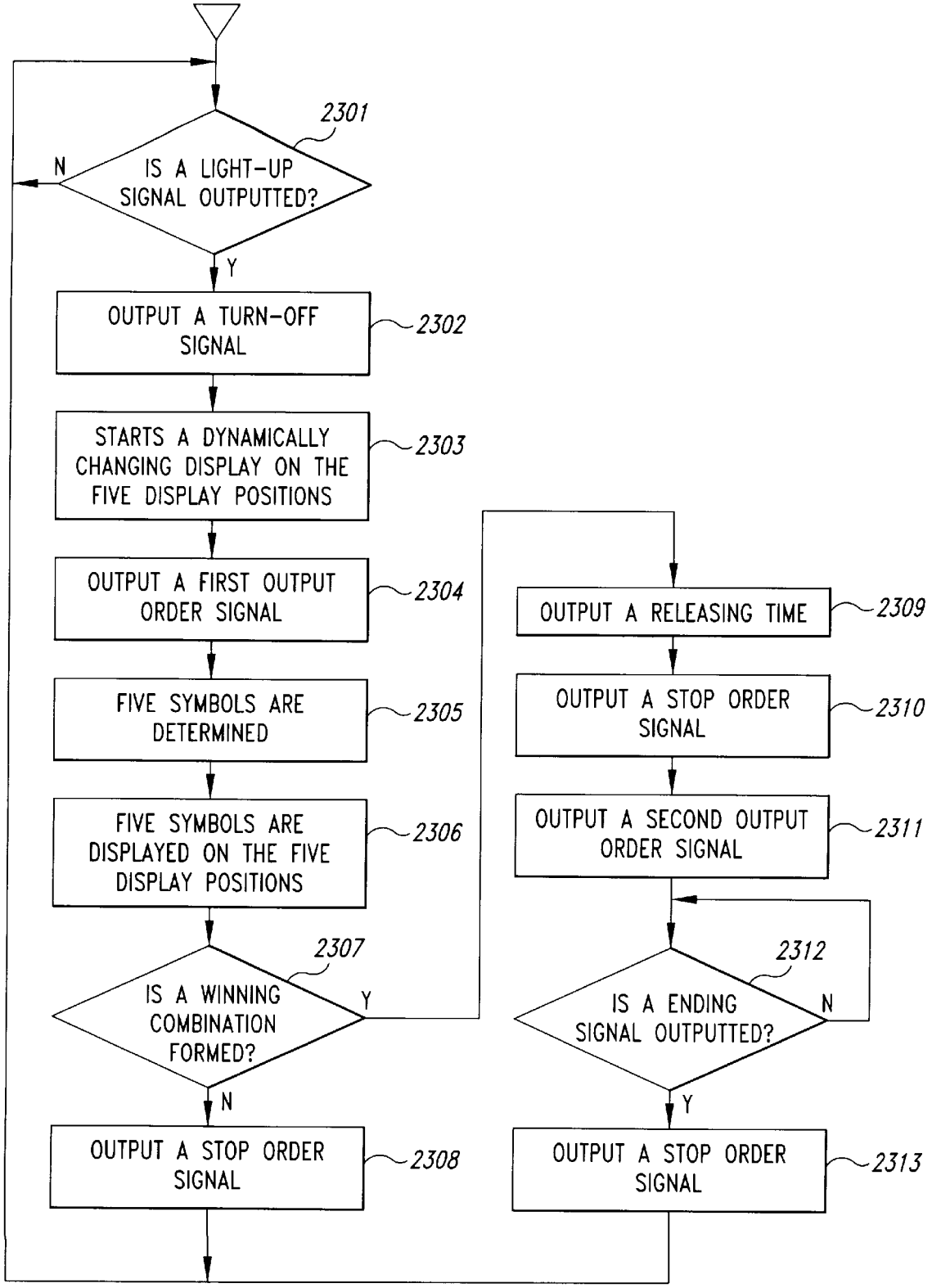
FIG. 19 is a flowchart showing an operational flow of a processor included in the card symbol display section control unit in the pachinko game machine of the third embodiment of the present invention.

FIG. 19 is a flowchart showing the operational flow of the processor 2201.

As shown in FIG. 19, in the card symbol display section control unit 701, when a light-up signal is outputted from the winning number display section control unit 703 (step 2301), the processor 2201 firstly outputs to the winning number display section control unit 703 a turn-off signal to let only one lamp go off (step 2302).

Subsequently, the processor 2201 controls the card symbol display section 107 to start a dynamically changing display of the symbols (symbols representing the back of cards) on the five display positions (step 2303), and at the same time, outputs a first output order signal indicating a command to output a first sound effect to the sound effect output device 706 (step 2304).

Subsequently, the processor 2201 determines five symbols out of a plurality of card symbols (step 2305).

Subsequently, the processor 2201 controls the card symbol display section 107 to display the five symbols which have been determined in step 2305 at each of the five display positions (step 2306).

Subsequently, the processor 2201 determines whether or not the five symbols determined in step 2305 correspond to any of the winning combinations, "two pairs", "three of a kind", "straight", "flush", "full house" and "four of a kind" (step 2307).

In the case where the five symbols do not correspond to any of the winning combinations, the processor 2201 outputs to the sound effect output device 706 a stop order signal indicating a command for stopping the first sound effect which is outputted from the sound effect output device 706 (step 2308), and then the operation returns to step 2301.

On the other hand, in the case where the five symbols correspond to one of the winning combinations, a winning-combination-and-time-period table (FIG. 17) stored in the memory 2202 is referenced and the releasing time period (the time period which triggers the variable winning section 105 to release the big-winning state) according to the winning combination is outputted to the variable winning section control unit 704 (step 2309). Specifically, when the five symbols correspond to the winning combination "two pairs", the processor 2201 outputs the releasing time period "4" to the variable winning section control unit 704, and when they correspond to the winning combination "three of a kind", the processor 2201 outputs the releasing time period "8" to the variable winning section control unit 704. Similarly, in the case of "straight", it outputs "12", in the case of "flush", it outputs "16", in the case of "full house", it outputs "20" and in the case of "four of a kind", it outputs "30", as a releasing time period, respectively to the variable winning section control unit 704.

Subsequently, the processor 2201 outputs a stop order signal indicating a command to stop the first sound effect outputted by the sound effect output device 706 (step 2310) and at the same time, a second output order signal indicating a command to output a second sound effect (step 2311). As a result, the variable winning section control unit 704 controls the time period which triggers the variable winning section 105 to release the big-winning state so as to be the releasing time period outputted from the card symbol display section control unit 701, and the sound effect output device 706 outputs the second sound effect.

Then the processor 2201 waits for the ending signal described below outputted from the variable winning section control unit 704 (step 2312), so as to output to the sound effect output device 706 the stop order signal indicating a command to stop the second sound effect outputted from the sound effect output device 706 (step 2313), and then the operation returns to step 2301.

Next, the variable winning section control unit 704 will be described with reference to FIGS. 20 and 21.

Figure 20:
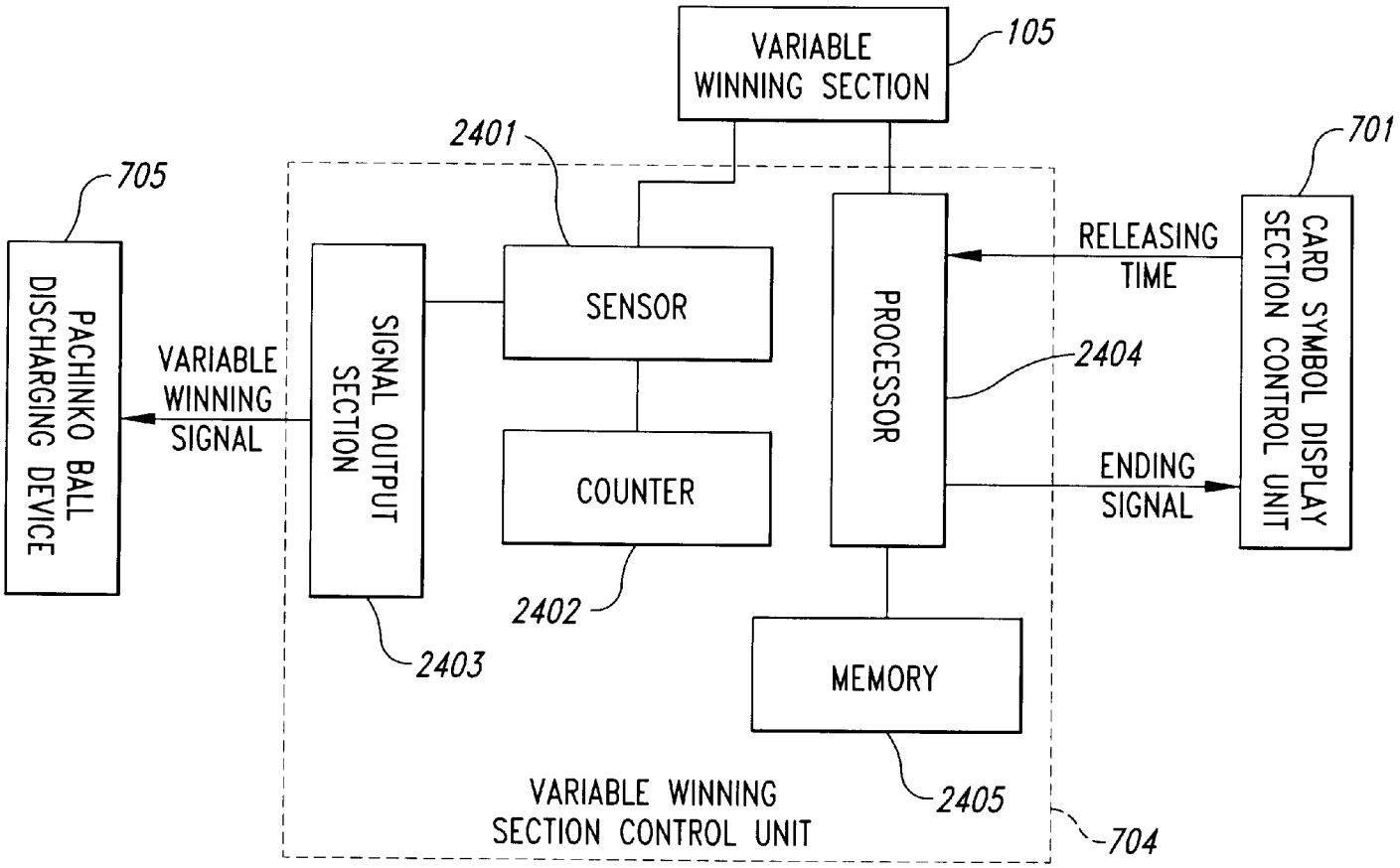
FIG. 20 is an explanatory view showing operation of a variable winning section control unit in the pachinko game machine of the third embodiment of the present invention.

As shown in FIG. 20, in the variable winning section control unit 704, every time the sensor 2401 detects that a pachinko ball drops into the variable winning section 105, the counter 2402 increments the counted value by "1", and the signal output section 2403 outputs to the pachinko ball discharging device 705 a variable winning signal indicating that a pachinko ball has dropped into the variable winning section 105.

Furthermore, the variable winning section control unit 704 further comprises a processor 2404 and a memory 2405, and the processor 2404 executes the programs stored in the memory 2405 to perform the operations.

Figure 21:
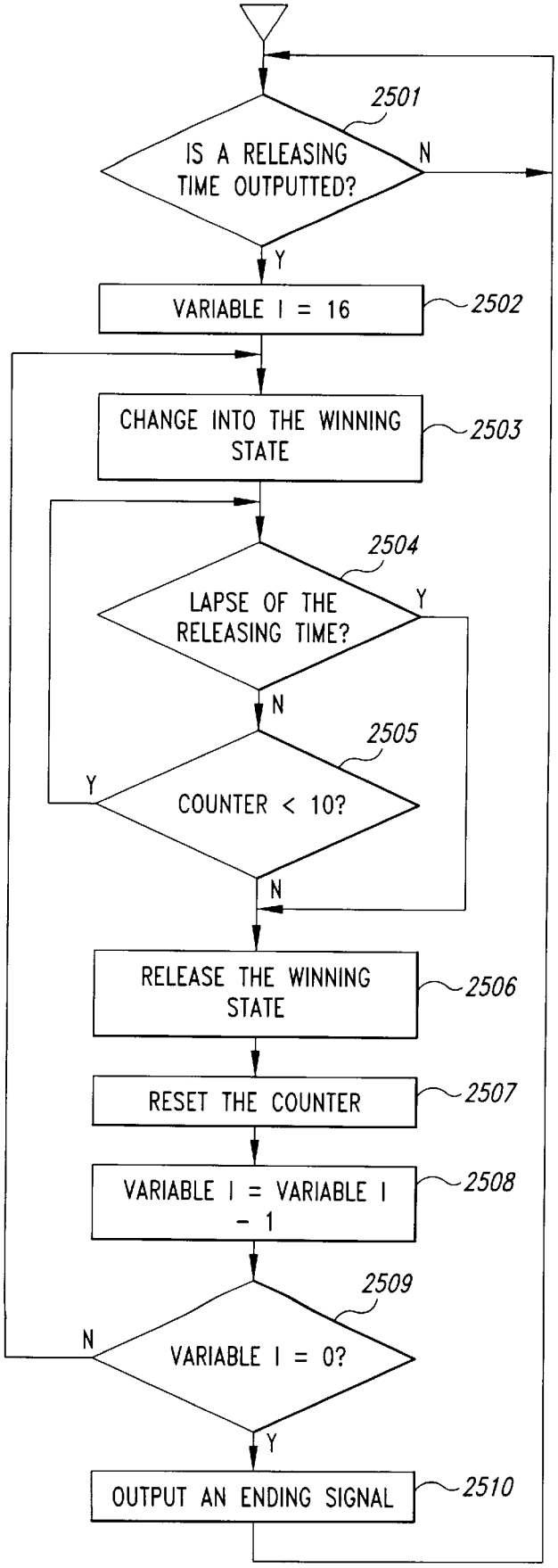
FIG. 21 is a flowchart showing an operational flow of a processor included in the variable winning section control unit in the pachinko game machine of the third embodiment of the present invention.

FIG. 21 is a flowchart showing the operational flow of the processor 2404.

As shown in FIG. 21, in the variable winning section control unit 704, when the releasing time period is outputted from the card symbol display section control unit 701 (step 2501), the processor 2404 sets "16" as variable I (step 2502), and then controls the variable winning section 105 to change into the big-winning state by opening the cover (step 2503). As a result, the variable winning section 105 changes into the big-winning state by opening the cover, and the number of pachinko balls which have dropped into the variable winning section 105, while the cover is kept open by the variable winning section 105, is counted by the counter 2402.

Subsequently, after a lapse of the releasing time period outputted from the card symbol display section control unit 701 (step 2504) or when the counted value becomes "10" before a lapse of the releasing time period (step 2505), the processor 2404 controls the variable winning section 105 to release the big-winning state by closing the cover (step 2506). As a result, the variable winning section 105 releases the big-winning state by closing the cover.

Subsequently, the processor 2404 resets the counted value of the counter 2402 (step 2507) and at the same time, subtracts "1" from the variable I (step 2508).

As a result of subtraction of "1" from the variable I, it is determined whether or not the value of the variable I becomes "0" (step 2509). In the case where it has not become "0", the operation returns to step 2503, and when it becomes "0", the processor 2404 outputs to the card symbol display section control unit 701 an ending signal indicating that all of the changes into the big-winning state of the variable winning section 105 have been completed (step 2510).

By the way, in the aforementioned operational example of a pachinko game machine, it has been described that the card symbol display section control unit 701 determines five symbols and the releasing time period is decided according to the winning combination corresponding to the five symbols. Conversely, it is possible to determine the releasing time period in advance and then decide five symbols according to the determined releasing time period. Hereinafter, such an example of the operation of the pachinko game machine will be described with reference to FIG. 22. In such a pachinko game machine, only the operation of the card symbol display section control unit 701 is different from the above described example.

Figure 22:
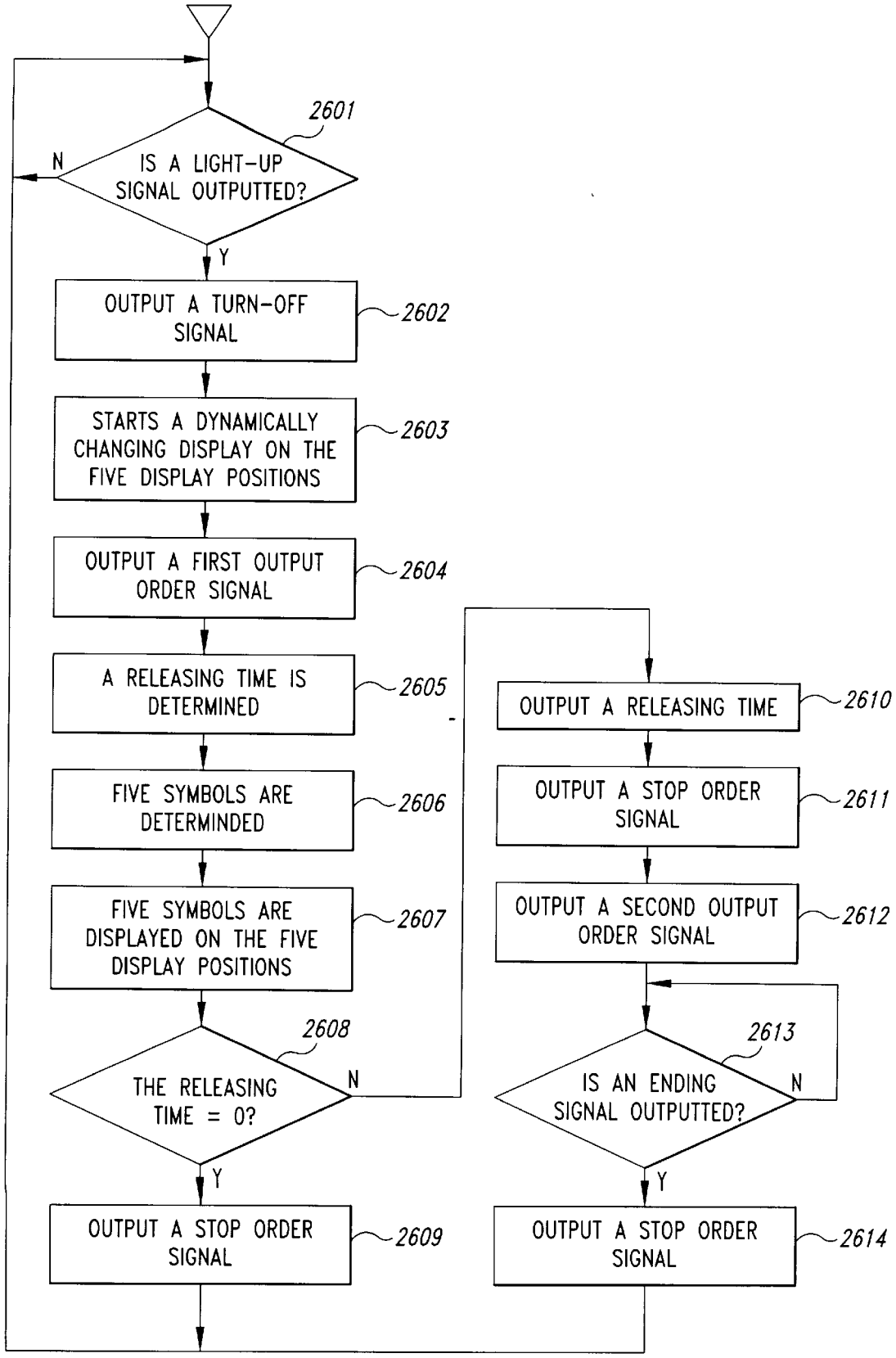
FIG. 22 is a flowchart showing another operational flow of the processor included in the card symbol display section control unit in the pachinko game machine of the third embodiment of the present invention.

FIG. 22 is a flowchart showing the operational flow of the processor 2201.

As shown in FIG. 22, in the card symbol display section control unit 701, in the case where a light-up signal is outputted from the winning number display section control unit 703 (step 2601), the processor 2201 outputs to the winning number display section control unit 703 a turn-off signal to let only one lamp go out (step 2602).

Subsequently, the processor 2201 controls the card symbol display section 107 to start a dynamically changing display of the symbols (representing the back of cards) on the five display positions (step 2603), and at the same time, outputs a first output order signal indicating a command to output the first sound effect to the sound effect output device 706 (step 2604).

Subsequently, the processor 2201 references the winning-combination-and-time-period table stored in the memory 2202, and determines a releasing time period including "0" (step 2605). Specifically, the processor 2201 determines a releasing time period from among "0", "4", "8", "12", "6", "20", and "30". At this stage, similarly to the above first embodiment, in order to assign weights to each of the releasing time periods, it should be determined in accordance with the predetermined probability value.

Subsequently, the processor 2201 references the winning-combination-and-time-period table stored in the memory 2202, and determines five symbols out of a plurality of card symbols in accordance with the releasing time period which has been determined in step 2605 (step 2606).

Subsequently, the processor 2201 controls the card symbol display section 107 so as to display the five symbols determined in step 2606 on each of the five display positions (step 2607).

Subsequently, the processor 2201 determines whether or not the releasing time period which has been decided in step 2605 is "0" (step 2608), and in the case where it is "0", the processor 2201 outputs to the sound effect output device 706 a stop order signal, indicating a command to stop the first sound effect outputted from the sound effect-output device 706 (step 2609), and then the operation returns to step 2601.

In the case where the releasing time period which has been decided in step 2605 is other than "0", the processor 2201 outputs the releasing time period to the variable winning section control unit 704 (step 2610).

Subsequently, the processor 2201 outputs to the sound effect output device 706 a stop order signal indicating a command to stop the first sound effect outputted by the sound effect output device 706 (step 2611), and at the same time, outputs to the sound effect output device 706 a second output order signal indicating a command to output the second sound effect (step 2612).

The processor 2201 then waits for the ending signal outputted from the variable winning section control unit 704 (step 2613), so as to output to the sound effect output device 706 the stop order signal indicating a command to stop the second sound effect outputted from the sound effect output device 706 (step 2614), and then the operation returns to step 2601.

As described above, according to the gaming machine of the third embodiment, the releasing time period which triggers the variable winning section 105 to release the big-winning state varies in accordance with the strengths (levels) of the winning combinations of the poker game, to which the displayed symbols on the five display positions correspond, the stronger a winning combination is, the greater the level of enjoyment of a player, as in a case of playing a poker game. Therefore, the player can play the game enjoying the atmosphere of playing a poker game.

Next, the fourth embodiment of the present invention will be described.

The front view of the pachinko game machine having a game card playing function of the fourth embodiment is the same as the one shown in FIG. 1. The pachinko game machine of the fourth embodiment is designed to change the number of pachinko balls which triggers the variable winning section 135 to release a big-winning state in accordance with the winning combination of the poker game to which the displayed symbols on the five display positions correspond.

Specifically, in the fourth embodiment, as shown in FIG. 23, when the displayed symbols on the five display positions correspond to the winning combination "two pairs", "2" is set as the number of pachinko balls to trigger release of the big-winning state by the variable winning section 105, and when the displayed symbols on the five display positions correspond to the winning combination "three of a kind", "3" is set as the number of pachinko balls to trigger release of the big-winning state by the variable winning section 105. Similarly, the number of pachinko balls is set as "4" in the case of "straight", it is set as "5" in the case of "flush", it is set as "6" in the case of "full house" and it is set as "10" in the case of "four of a kind".

When a pachinko ball drops into the specific winning position 104 and then the card symbol display section 107 performs updating and displaying of the five symbols, the variable winning section 105 changes into the big-winning state by opening the cover only the predetermined number of times (for example, 16 times) in the case where the displayed symbols on the five display positions correspond to one of the winning combinations "two pairs", "three of a kind", "flush", "full house" and "four of a kind". For one big-winning state, the variable winning section 105 closes the cover to release the big-winning state after the number of pachinko balls in accordance with the formed winning combination (one of the numbers "2", "3", "4", "5", "6" and "10" in accordance with a winning combination) have dropped in or after a lapse of a predetermined time period (for example 30 seconds).

Next, there will be described a control unit for performing the operation of the pachinko game machine of the fourth embodiment.

The structural view of the control unit of the fourth embodiment is the same as the one shown in FIG. 3. In the pachinko game machine of the fourth embodiment, only the operations of the card symbol display section control unit 701 and the variable winning section control unit 704 are different from the first embodiment.

Firstly, the card symbol display section control unit 701 will be described with reference to FIGS. 24 and 25.

Figure 24:
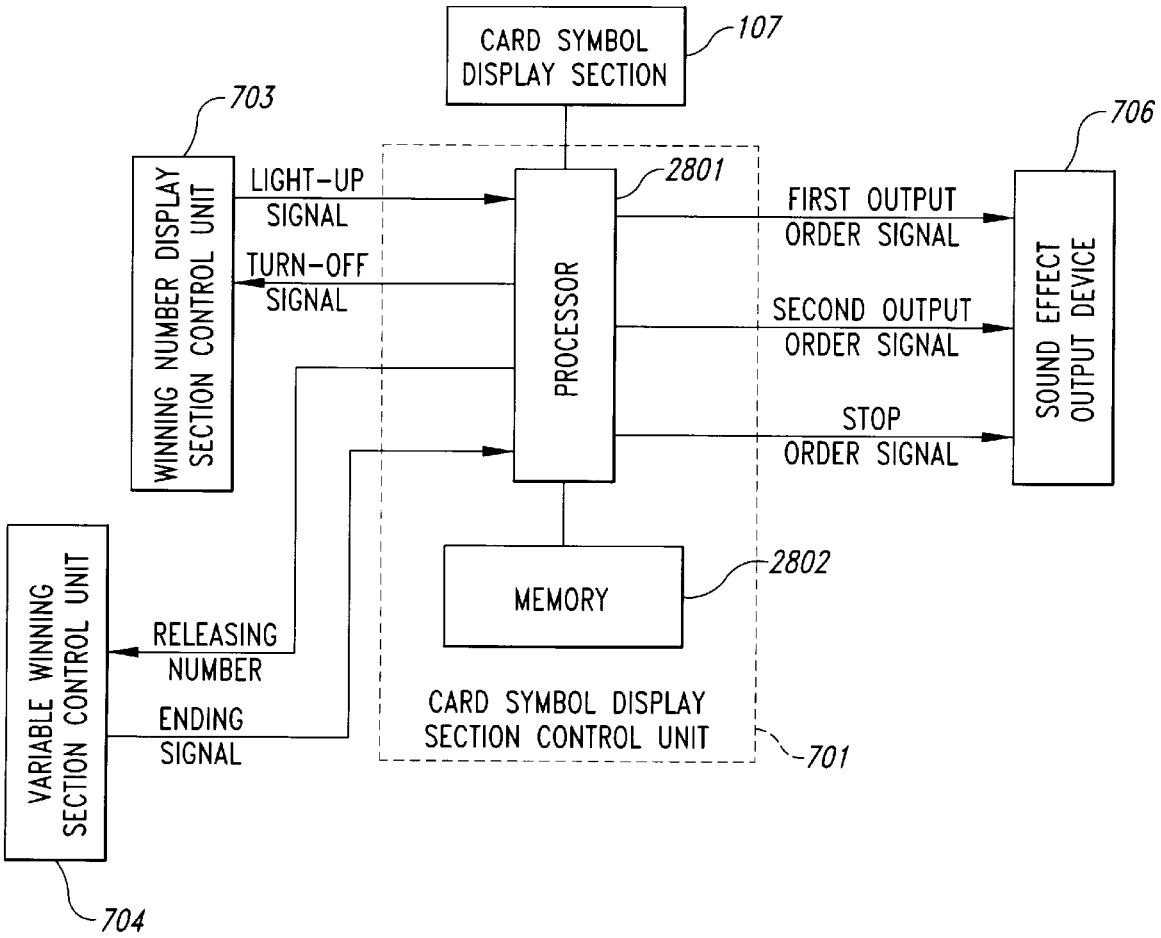
FIG. 24 is an explanatory view showing operation of a card symbol display section control unit in the pachinko game machine of the fourth embodiment of the present invention.

As shown in FIG. 24, the card symbol display section control unit 701 comprises a processor 2801 and a memory 2802, and the processor 2801 executes programs stored in the memory 2802 to perform the operations.

Figure 25:
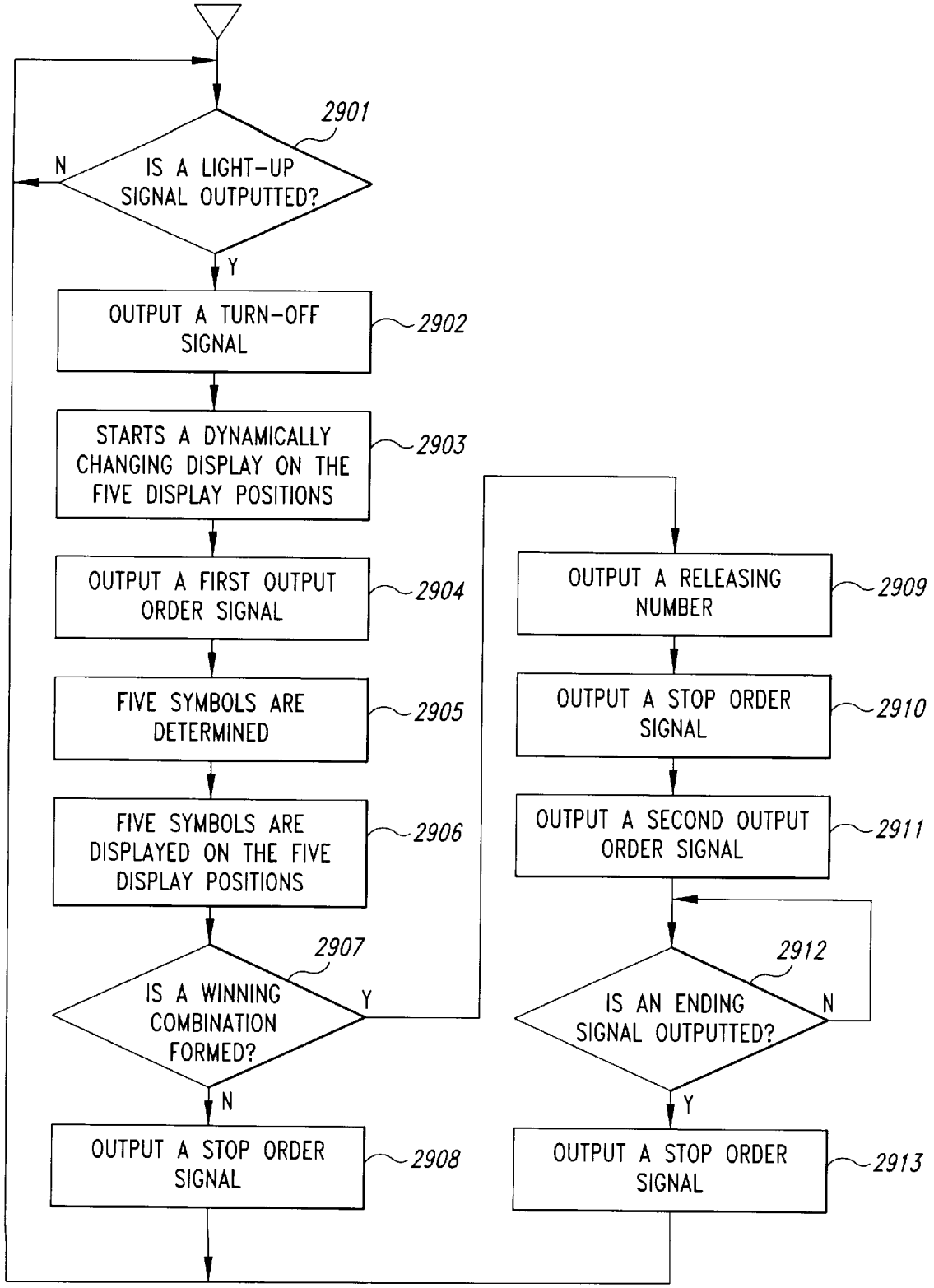
FIG. 25 is a flowchart showing an operational flow of a processor included in the card symbol display section control unit in the pachinko game machine of the fourth embodiment of the present invention.

FIG. 25 is a flowchart showing the operational flow of the processor 2801.

As shown in FIG. 25, in the card symbol display section control unit 701, when a light-up signal is outputted from the winning number display section control unit 703 (step 2901), the processor 2801 firstly outputs to the winning number display section control unit 703 a turn-off signal to let only one lamp go out (step 2902).

Subsequently, the processor 2801 controls the card symbol display section 107 to start a dynamically changing display of the symbols (symbols representing the back of cards) on the five display positions (step 2903), and at the same time, outputs a first output order signal indicating a command to output a first sound effect to the sound effect output device 706 (step 2904).

Subsequently, the processor 2801 determines five symbols out of a plurality of card symbols (step 2905).

Subsequently, the processor 2801 controls the card symbol display section 107 to display the five symbols which have been determined in step 2905 on each of the five display positions (step 2906).

Subsequently, the processor 2801 determines whether or not the five symbols determined in step 2905 correspond to any of the winning combinations, "two pairs", "three of a kind", "straight", "flush", "full house" and "four of a kind" (step 2907).

In the case where the five symbols do not correspond to any of the winning combinations, the processor 2801 outputs to the sound effect output device 706 a stop order signal indicating a command for stopping the first sound effect which is outputted from the sound effect output device 706 (step 2908), and then the operation returns to step 2901.

On the other hand, in the case where the five symbols correspond to one of the winning combinations, a winning-combination-and-number table stored in the memory 2802 is referenced and the releasing number (the number of pachinko balls which triggers the variable winning section 105 to release the big-winning state) according to the winning combination is outputted to the variable winning section control unit 704 (step 2909).

Specifically, when the five symbols correspond to the winning combination "two pairs", the processor 2801 outputs the releasing number "2" to the variable winning section control unit 704, and when they correspond to the winning combination "three of a kind", the processor 2801 outputs the releasing time period "3" to the variable winning section control unit 704. Similarly, in the case of "straight", it outputs "4", in the case of "flush", it outputs "5", in the case of "full house", it outputs "6" and in the case of "four of a kind", it outputs "10", as releasing numbers respectively, to the variable winning section control unit 704.

Subsequently, the processor 2801 outputs a stop order signal indicating a command to stop the first sound effect outputted by the sound effect output device 706 (step 2910) and at the same time, a second output order signal indicating a command to output a second sound effect (step 2911).

The processor 2801 then waits for the ending signal described below outputted from the variable winning section control unit 704 (step 2912), so as to output to the sound effect output device 706 a stop order signal indicating a command to stop the second sound effect outputted from the sound effect output device 706 (step 2913), and then the operation returns to step 2901.

Next, the variable winning section control unit 704 will be described with reference to FIGS. 26 and 27.

Figure 26:
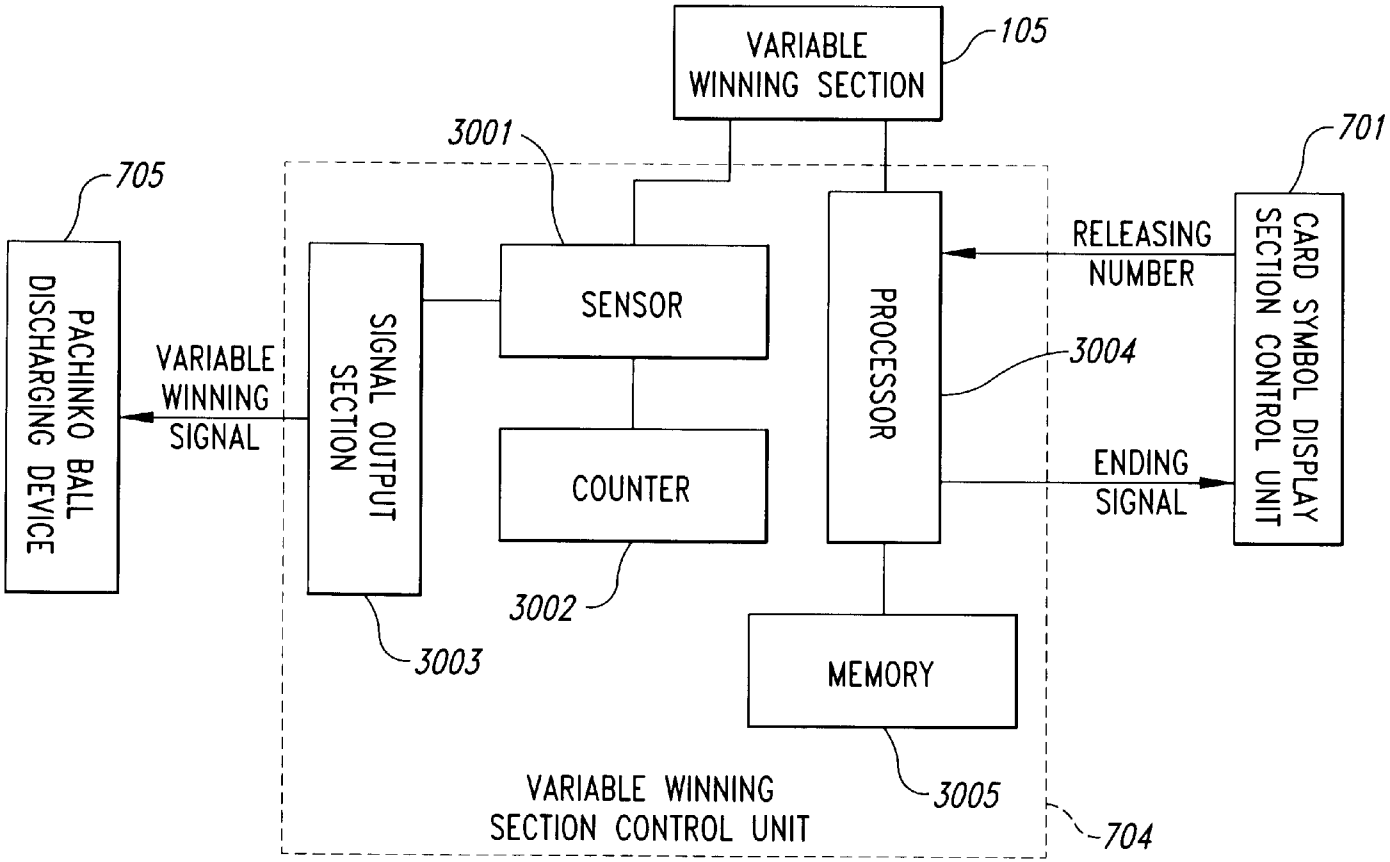
FIG. 26 is an explanatory view showing operation of a variable winning section control unit in the pachinko game machine of the fourth embodiment of the present invention.

As shown in FIG. 26, in the variable winning section control unit 704, every time the sensor 3001 detects that a pachinko ball drops into the variable winning section 105, the counter 3002 increments the counted value by "1", and the signal output section 3003 outputs to the pachinko ball discharging device 705 a variable winning signal indicating that a pachinko ball has dropped into the variable winning section 105.

Furthermore, the variable winning section control unit 704 further comprises a processor 3004 and a memory 3005, and the processor 3004 executes the programs stored in the memory 3005 to perform the operations.

Figure 27:
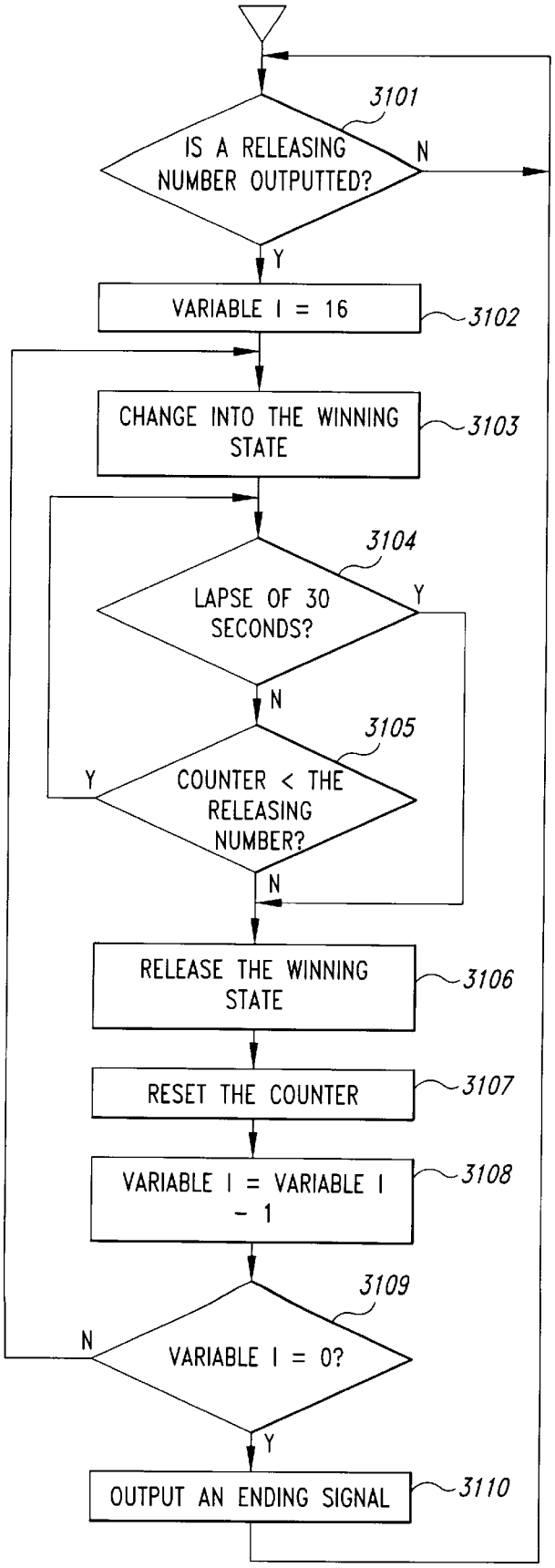
FIG. 27 is a flowchart showing an operational flow of a processor included in the variable winning section control unit in the pachinko game machine of the fourth embodiment of the present invention.

FIG. 27 is a flowchart showing the operational flow of the processor 3004.

As shown in FIG. 27, in the variable winning section control unit 704, when the releasing number is outputted from the card symbol display section control unit 701 (step 3101), the processor 3004 sets "16" as variable I (step 3102), and then controls the variable winning section 105 to change into the big-winning state by opening the cover (step 3103). As a result, the variable winning section 105 changes into the big-winning state by opening the cover, and the number of pachinko balls which have dropped into the variable winning section 105 while the cover is kept open by the variable winning section 105, is counted by the counter 3002.

Subsequently, after a lapse of 30 seconds (step 3104) or when the counted value reaches the releasing number outputted from the card symbol display section control unit 701 before a lapse of 30 seconds (step 3105), the processor 3004 controls the variable winning section 105 to release the big-winning state by closing the cover (step 3106). As a result, the variable winning section 105 releases the big-winning state by closing the cover.

Subsequently, the processor 3004 resets the counted value of the counter 3002 (step 3107) and at the same time, subtracts "1" from the variable I (step 3108).

As a result of subtraction of "1" from the variable I, it is determined whether or not the value of the variable I becomes "0" (step 3109). In the case where it has not become "0", the operation returns to step 3103, and when it becomes "0", the processor 3004 outputs to the card symbol display section control unit 701 an ending signal indicating that all of the changes into the big-winning state of the variable winning section 105 have been completed (step 3110).

By the way, in the aforementioned operational example of the pachinko game machine, it has been described that the card symbol display section control unit 701 determines five symbols and the releasing number of pachinko balls is decided according to the winning combination corresponding to the five symbols. Conversely, it is possible to determine the releasing number of pachinko balls in advance and then decide five symbols according to the determined releasing number. Hereinafter, such an example of the operation will be described with reference to FIG. 28. In such a pachinko game machine, only the operation of the card symbol display section control unit 701 is different from the above described example.

Figure 28:
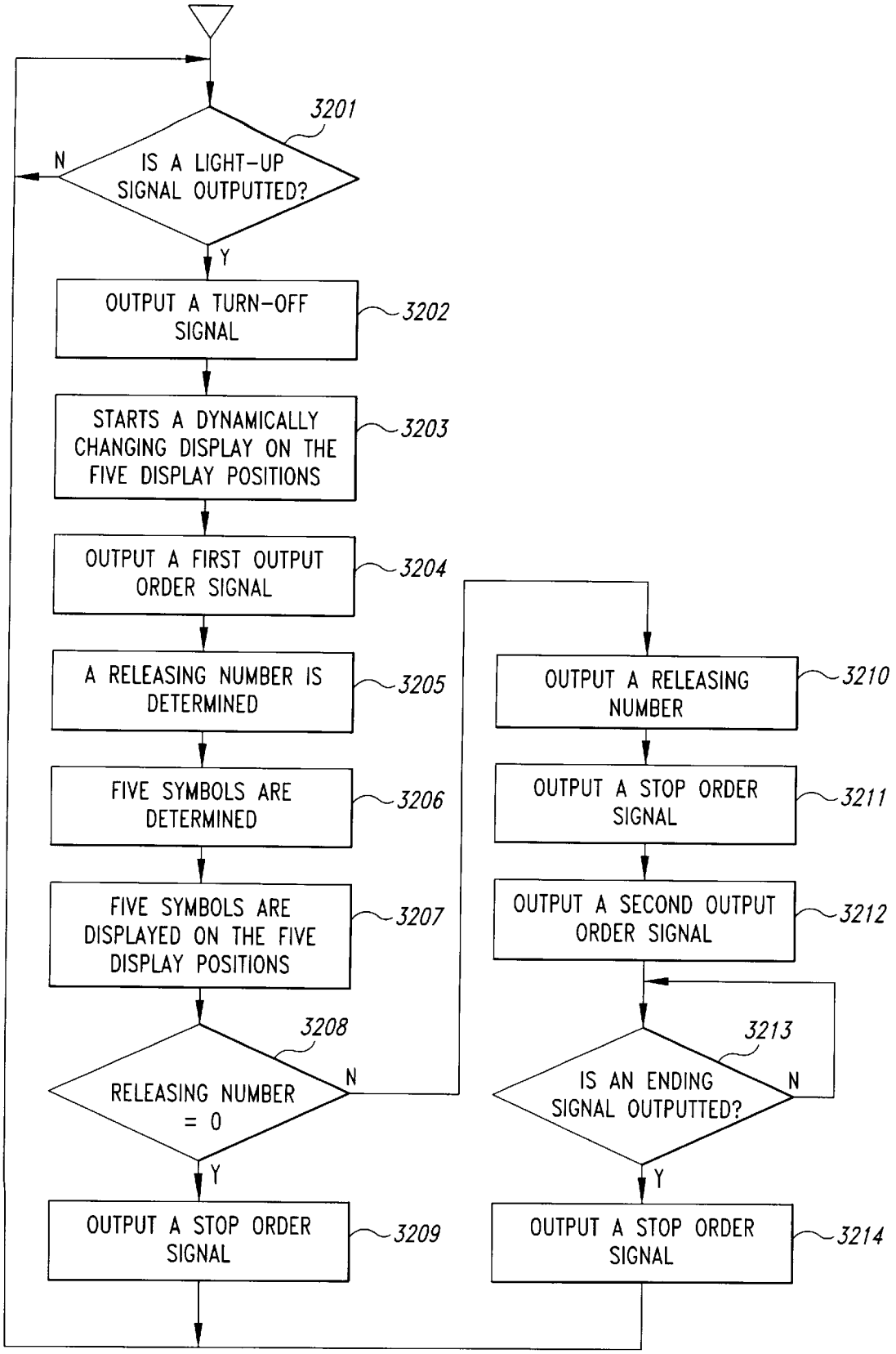
FIG. 28 is a flowchart showing another operational flow of the processor included in the card symbol display section control unit in the pachinko game machine of the fourth embodiment of the present invention.

FIG. 28 is a flowchart showing the operational flow of the processor 2801.

As shown in FIG. 28, in the card symbol display section control unit 701, in the case where a light-up signal is outputted from the winning number display section control unit 703 (step 3201), the processor 2801 outputs to the winning number display section control unit 703 a turn-off signal to let only one lamp go out (step 3202).

Subsequently, the processor 2801 controls the card symbol display section 107 to start a dynamically changing display of the symbols (representing the back of cards) on the five display positions (step 3203), and at the same time, outputs a first output order signal indicating a command to output the first sound effect to the sound effect output device 706 (step 3204).

Subsequently, the processor 2801 references the winning-combination-and-number table stored in the memory 2802, and determines a releasing number of pachinko balls including "0" (step 3205). Specifically, the processor 2801 determines as a releasing number of pachinko balls one from "0", "2", "3", "4", "5", "6", and "10". At this stage, similarly to the above first embodiment, in order to assign weights to each of the releasing numbers of pachinko balls, it should be determined in accordance with the predetermined probability value.

Subsequently, the processor 2801 references the winning-combination-and-number table stored in the memory 2802, and determines five symbols out of a plurality of card symbols in accordance with the releasing number of pachinko balls which has been determined in step 3205 (step 3206).

Specifically, the processor 2801 determines symbols out of fifty-two symbols representing fifty-two cards respectively, and in the case where the releasing number is "10", five symbols which form the winning combination of "four of a kind" are determined, and in the case where the releasing number is "6", five symbols which form the winning combination of "full house" are determined. Similarly, five symbols which form other winning combinations are determined respectively, such as, in the case where the releasing number is "5", "flush", in the case where the releasing number is "4", "straight", in the case where the releasing number is "3", "three of a kind", and in the case where the releasing number is "2", "two pairs". In the case where the releasing number is "0", five symbols which do not form any of the winning combinations are determined.

Subsequently, the processor 2801 controls the card symbol display section 107 so as to display the five symbols determined in step 3206 on each of the five display positions (step 3207).

Subsequently, the processor 2801 determines whether or not the releasing number which has been decided in step 3205 is "0" (step 3208), and in the case where it is "0", the processor 2801 outputs to the sound effect output device 706 a stop order signal, indicating a command to stop the first sound effect outputted from the sound effect output device 706 (step 3209), and then the operation returns to step 3201.

In the case where the releasing number which has been decided in step 3205 is other than "0", the processor 2801 outputs the releasing number to the variable winning section control unit 704 (step 3210).

Subsequently, the processor 2801 outputs to the sound effect output device 706 a stop order signal indicating a command to stop the first sound effect outputted by the sound effect output device 706 (step 3211), and at the same time, outputs to the sound effect output device 706 a second output order signal indicating a command to output the second sound effect (step 3212).

The processor 2801 then waits for the ending signal outputted from the variable winning section control unit 704 (step 3213), so as to output to the sound effect output device 706 the stop order signal indicating a command to stop the second sound effect outputted from the sound effect output device 706 (step 3214), and then the operation returns to step 3201.

As described above, according to the gaming machine of the fourth embodiment, the releasing number of pachinko balls which triggers the variable winning section 105 to release the big-winning state varies in accordance with the strengths (levels) of the winning combinations of the poker game, to which the displayed symbols on the five display positions correspond. The stronger a winning combination is, the greater a player's level of enjoyment, as in a case of playing a poker game. Therefore, the player can play the game enjoying the atmosphere of playing a poker game.

Next, the fifth embodiment of the present invention will be described.

The front view of the pachinko game machine having a game card playing function of the fifth embodiment is the same as the one shown in FIG. 1. The pachinko game machine of the fifth embodiment is designed to change the number of pachinko balls which are discharged to the player for each of the pachinko balls which have dropped into the variable winning section 105 in accordance with the winning combination of the poker game to which the displayed symbols on the five display positions correspond.

Specifically, in the fifth embodiment, as shown in FIG. 29, when the displayed symbols on the five display positions correspond to the winning combination "two pairs", "2" is set as the number of pachinko balls to be discharged to the player for each of the pachinko balls which have dropped into the variable winning section 105, and when the displayed symbols on the five display positions correspond to the winning combination "three of a kind", "4" is set as the number of pachinko balls to be discharged to the player for each of the pachinko balls which have been dropped into the variable winning section 105. Similarly, the number of pachinko balls to be discharged to the player is changed for each of the pachinko balls which have been dropped into the variable winning section 105. For example, it is set as "6" in the case of "straight", it is set as "8" in the case of "flush", it is set as "10" in the case of "full house" and it is set as "15" in the case of "four of a kind".

When a pachinko ball drops into the specific winning position 104 and then the card symbol display section 107 performs updating and displaying of the five symbols, the variable winning section 105 changes into the big-winning state by opening the cover only the predetermined times (for example, 16 times) in the case where the displayed symbols on the five display positions correspond to one of the winning combinations "two pairs", "three of a kind", "straight", "flush", "full house" and "four of a kind", one big-winning state, the variable winning section 105 closes the cover to release the big-winning state after a predetermined number of pachinko balls (for example ten) have dropped in or after a lapse of a predetermined time period (for example thirty seconds). Then, the number of pachinko balls in accordance with the formed winning combination (the number "2", "4", "6", "8", "10" or "15" in accordance with the winning combination) for each of the pachinko balls which have dropped into the variable winning section 105 during one big winning state, that is, during one round, are discharged into the tray 102.

Next, there will be described a control unit for performing the operations of the pachinko game machine of the fifth embodiment. The structural view of the control unit of the fifth embodiment is the same as the one shown in FIG. 3. In the pachinko game machine of the fifth embodiment, only the operations of the card symbol display section control unit 701, the variable winning section control unit 704, and the pachinko ball discharging device 705 are different from the first embodiment.

Firstly, the card symbol display section control unit 701 will be described with reference to FIGS. 30 and 31.

Figure 30:
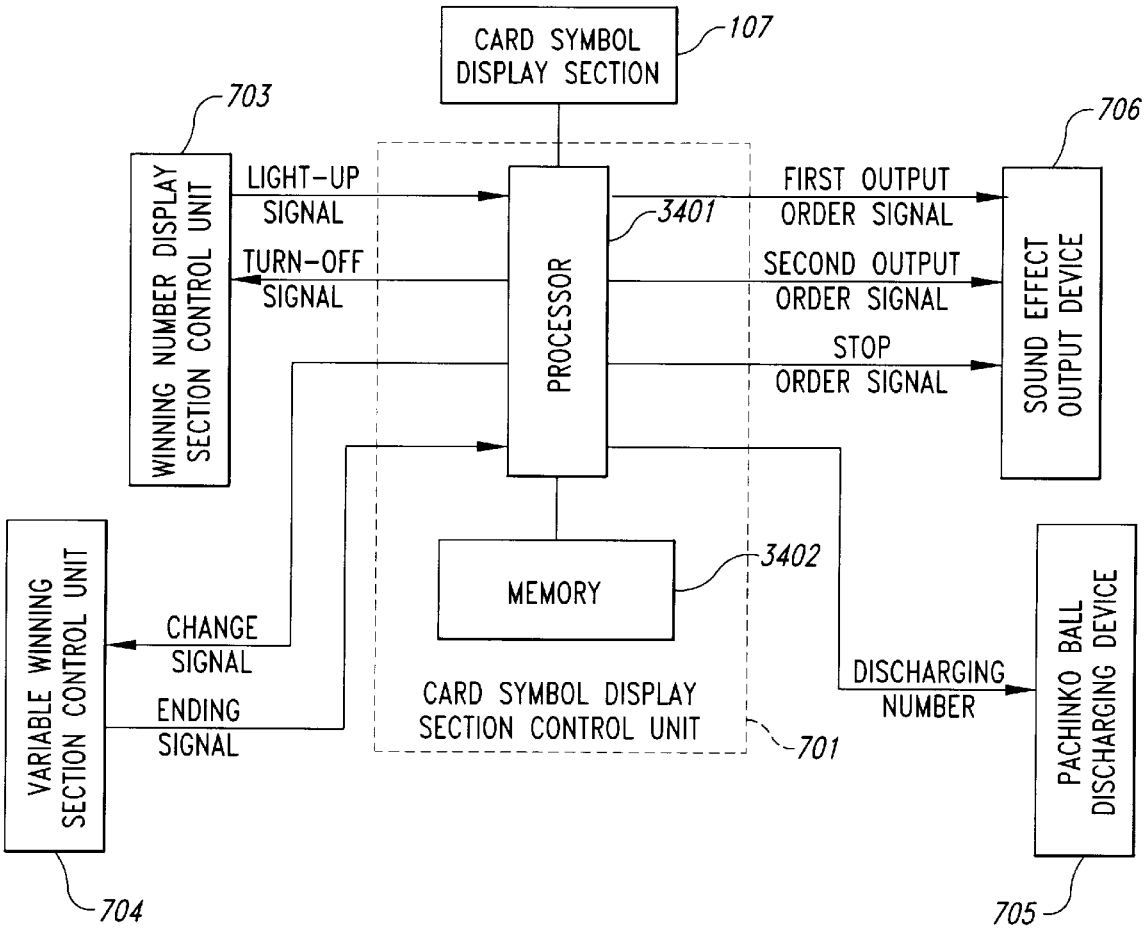
FIG. 30 is an explanatory view showing operation of a card symbol display section control unit in the pachinko game machine of the fifth embodiment of the present invention.

As shown in FIG. 30, the card symbol display section control unit 701 comprises a processor 3401 and a memory 3402, and the processor 3401 executes programs stored in the memory 3402 to perform the operation.

Figure 31:
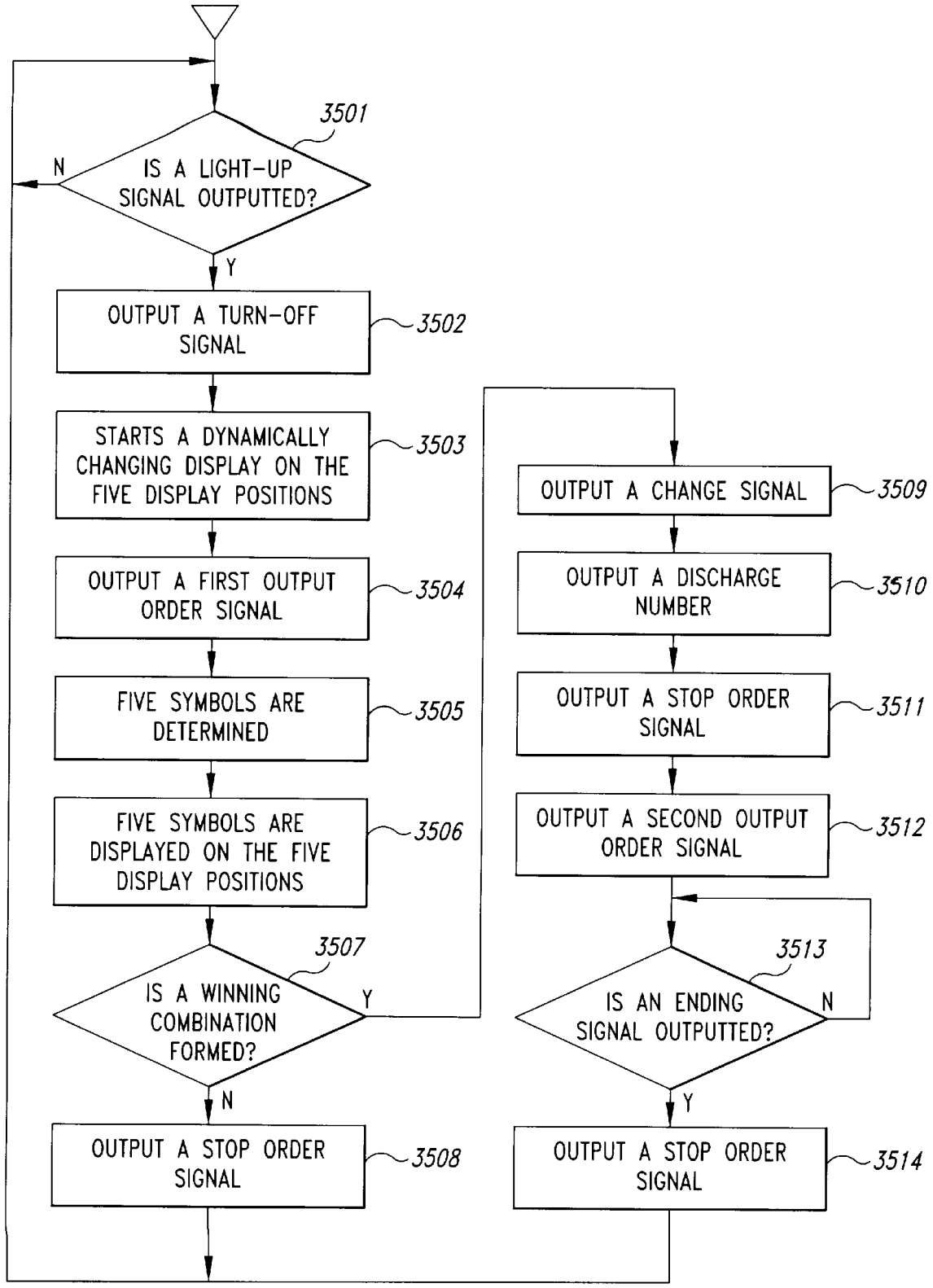
FIG. 31 is a flowchart showing an operational flow of a processor included in the card symbol display section control unit in the pachinko game machine of the fifth embodiment of the present invention.

FIG. 31 is a flowchart showing the operational flow of the processor 3401.

As shown in FIG. 31, in the card symbol display section control unit 701, when a light-up signal is outputted from the winning number display section control unit 703 (step 3501), the processor 3401 firstly outputs to the winning number display section control unit 703 a turn-off signal to let only one lamp go out(step 3502).

Subsequently, the processor 3401 controls the card symbol display section 107 to start a dynamically changing display of the symbols (symbols representing the back of cards) on the five display positions (step 3503), and at the same time, outputs a first output order signal indicating a command to output the first sound effect to the sound effect output device 706 (step 3504). As a result, the card symbol display section 107 displays a plurality of symbols representing the back of cards in such a manner that the symbols displayed on each of the five display positions are sequentially and dynamically changed, and the sound effect output device 706, as described above, outputs the first sound effect.

Subsequently, the processor 3401 determines five symbols out of a plurality of card symbols (step 3505).

Subsequently, the processor 3401 controls the card symbol display section 107 to display the five symbols which have been determined in step 3505 on each of the five display positions (step 3506).

Subsequently, the processor 3401 determines whether or not the five symbols determined in step 3505 correspond to any of the winning combinations, "two pairs", "three of a kind", "straight", "flush", "full house" and "four of a kind" (step 3507).

In the case where the five symbols do not correspond to any of the winning combinations, the operation outputs to the sound effect output device 706 a stop order signal indicating a command for stopping the first sound effect which is outputted from the sound effect output device 706 (step 3508), and then the operation returns to step 3501.

On the other hand, in the case where the five symbols correspond to one of the winning combinations, a winning-combination-and-number table (FIG. 29) stored in the memory 3402 is referenced and the discharging number (the number of pachinko balls which are discharged to the player for each of the pachinko balls having dropped into the variable winning section 105 according to the winning combination) is outputted to the pachinko ball discharging device 705 (step 3509). Specifically, when the five symbols correspond to the winning combination "two pairs", the processor 3401 outputs the discharging number "2" to the pachinko ball discharging device 705, and when they correspond to the winning combination "three of a kind", the processor 3401 outputs the discharging number "4" to the pachinko ball discharging device 705. Similarly, in the case of "straight", it outputs "6", in the case of "flush", it outputs "8", in the case of "full house", it outputs "10" and in the case of "four of a kind", it outputs "15" as discharging numbers respectively, to the pachinko ball discharging device 705.

Subsequently, the processor 3401 outputs to the variable winning section control unit 704 change signal as a command to change the variable winning section 105 into the big-winning state (step 3510).

Furthermore, the processor 3401 outputs to the sound effect output device 706 a stop order signal indicating a command to stop the first sound effect outputted by the sound effect output device 706 (step 3511), and at the same time, outputs to the sound effect output device 706 a second output order signal indicating a command to output a second sound effect (step 3512). The pachinko ball discharging device 705 discharges into the tray 102, a number of pachinko balls corresponding to the discharging number output from the card symbol display section control unit 701 for each of the pachinko balls which have dropped into the variable winning section 105.

The processor 3401 then waits for the ending signal described below outputted from the variable winning section control unit 704 (step 3513), so as to output to the sound effect output device 706 the stop order signal indicating a command to stop the second sound effect outputted from the sound effect output device 706 (step 3514), and then the operation returns to step 3501.

Next, the variable winning section control unit 704 will be described with reference to FIGS. 32 and 33.

Figure 32:
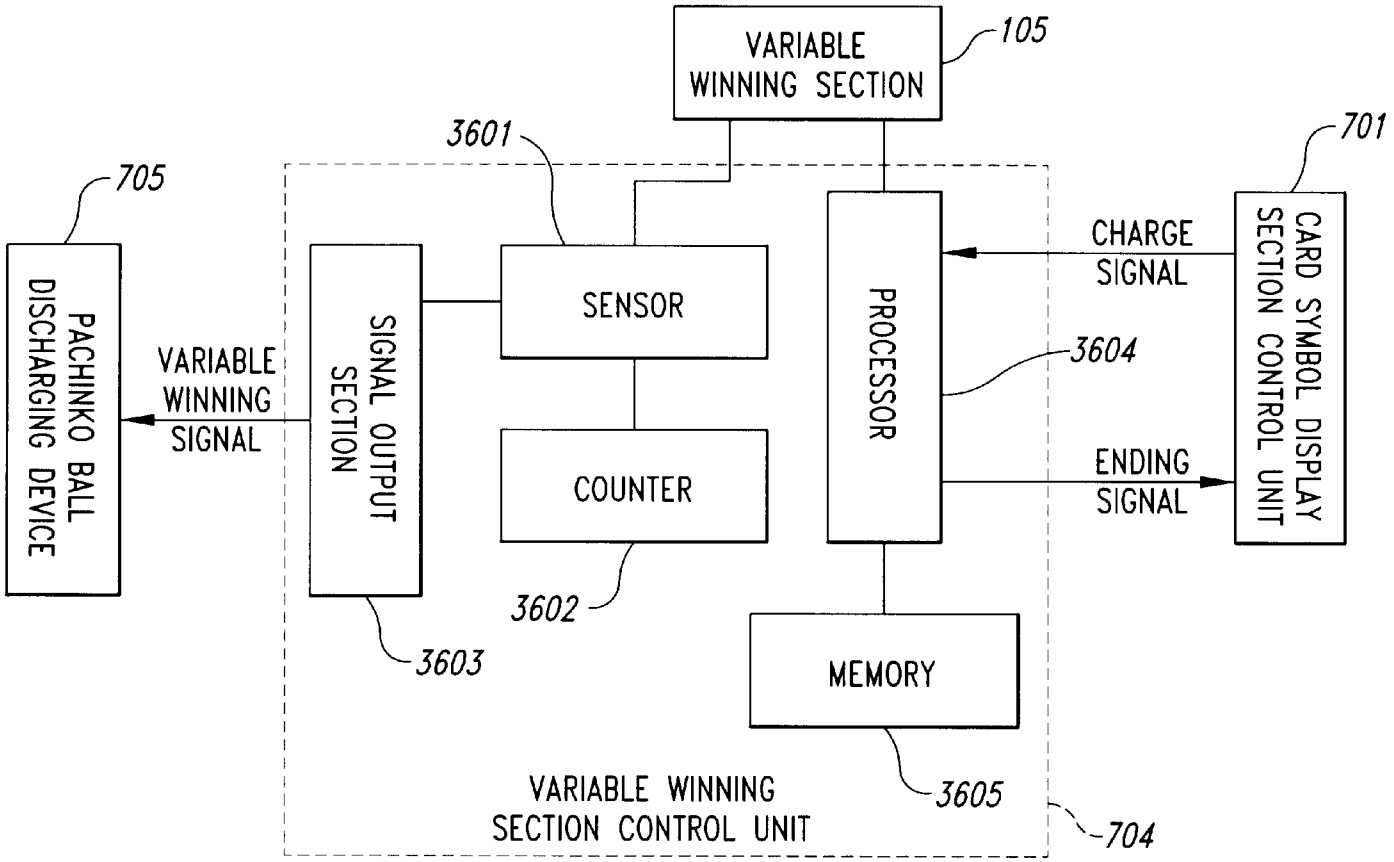
FIG. 32 is an explanatory view showing operation of a variable winning section control unit in the pachinko game machine of the fifth embodiment of the present invention.

As shown in FIG. 32, in the variable winning section control unit 704, every time the sensor 3601 detects that a pachinko ball drops into the variable winning section 105, the counter 3602 increments the counted value by "1", and the signal output section 3603 outputs to the pachinko ball discharging device 705 a variable winning signal indicating that a pachinko ball has dropped into the variable winning section 105.

Furthermore, the variable winning section control unit 704 further comprises a processor 3604 and a memory 3605, and the processor 3604 executes the programs stored in the memory 3605 to perform the operation.

Figure 33:
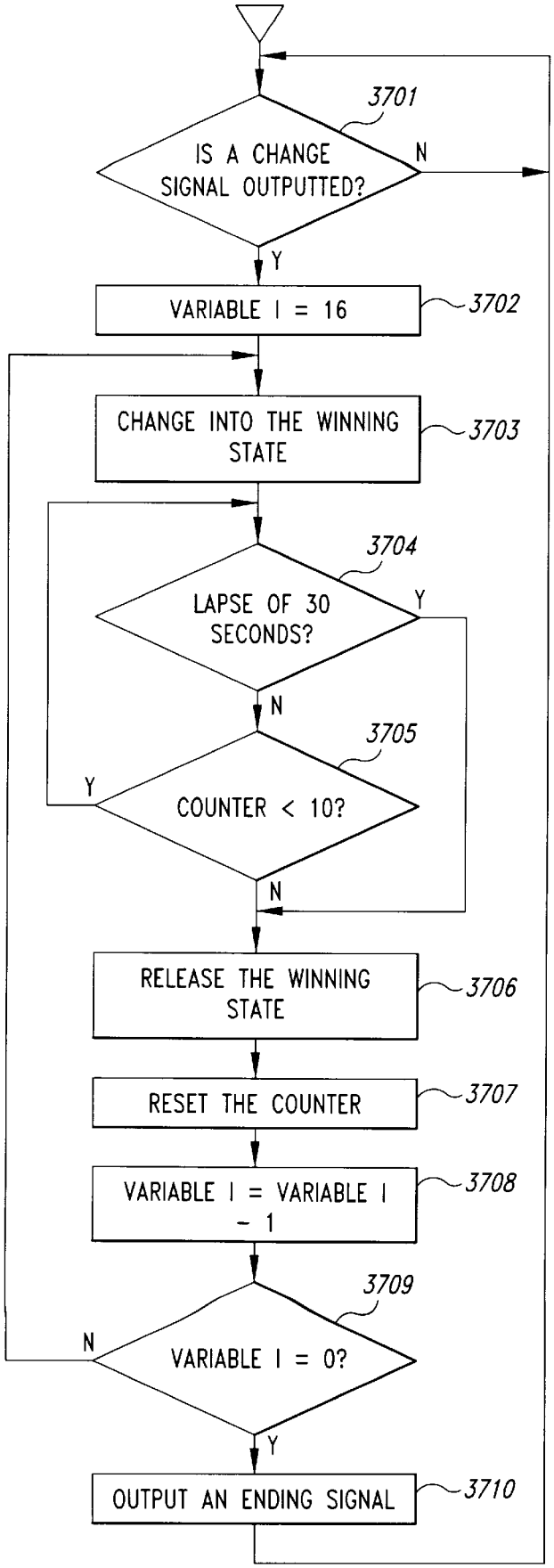
FIG. 33 is a flowchart showing an operational flow of a processor included in the variable winning section control unit in the pachinko game machine of the fifth embodiment of the present invention.

FIG. 33 is a flowchart showing the operational flow of the processor 3604.

As shown in FIG. 33, in the variable winning section control unit 704, when a change signal is outputted from the card symbol display section control unit 701 (step 3701), the processor 3604 sets "16" as variable I (step 3702), and then controls the variable winning section 105 to change into the big-winning state by opening the cover (step 3703). As a result, the variable winning section 105 changes into the big-winning state by opening the cover, and the number of pachinko balls which have dropped into the variable winning section 105 while the cover is kept open by the variable winning section 105, is counted by the counter 3602.

Subsequently, after a lapse of 30 seconds (step 3704) or when the counted value reaches "10" before a lapse of 30 seconds (step 3705), the processor 3604 controls the variable winning section 105 to release the big-winning state by closing the cover (step 3706). As a result, the variable winning section 105 releases the big-winning state by closing the cover.

Subsequently, the processor 3604 resets the counted value of the counter 3602 (step 3707) and at the same time, subtracts "1" from the variable I (step 3708).

As a result of subtraction of "1" from the variable I, it is determined whether or not the value of the variable I becomes "0" (step 3709). In the case where it has not become "0", the operation returns to step 3703, and when it becomes "0", the processor 3604 outputs to the card symbol display section control unit 701 an ending signal indicating that all of the changes into the big-winning state of the variable winning section 105 have been completed (step 3710).

Next, the pachinko ball discharging device 705 will be described with reference to FIG. 34.

Figure 34:
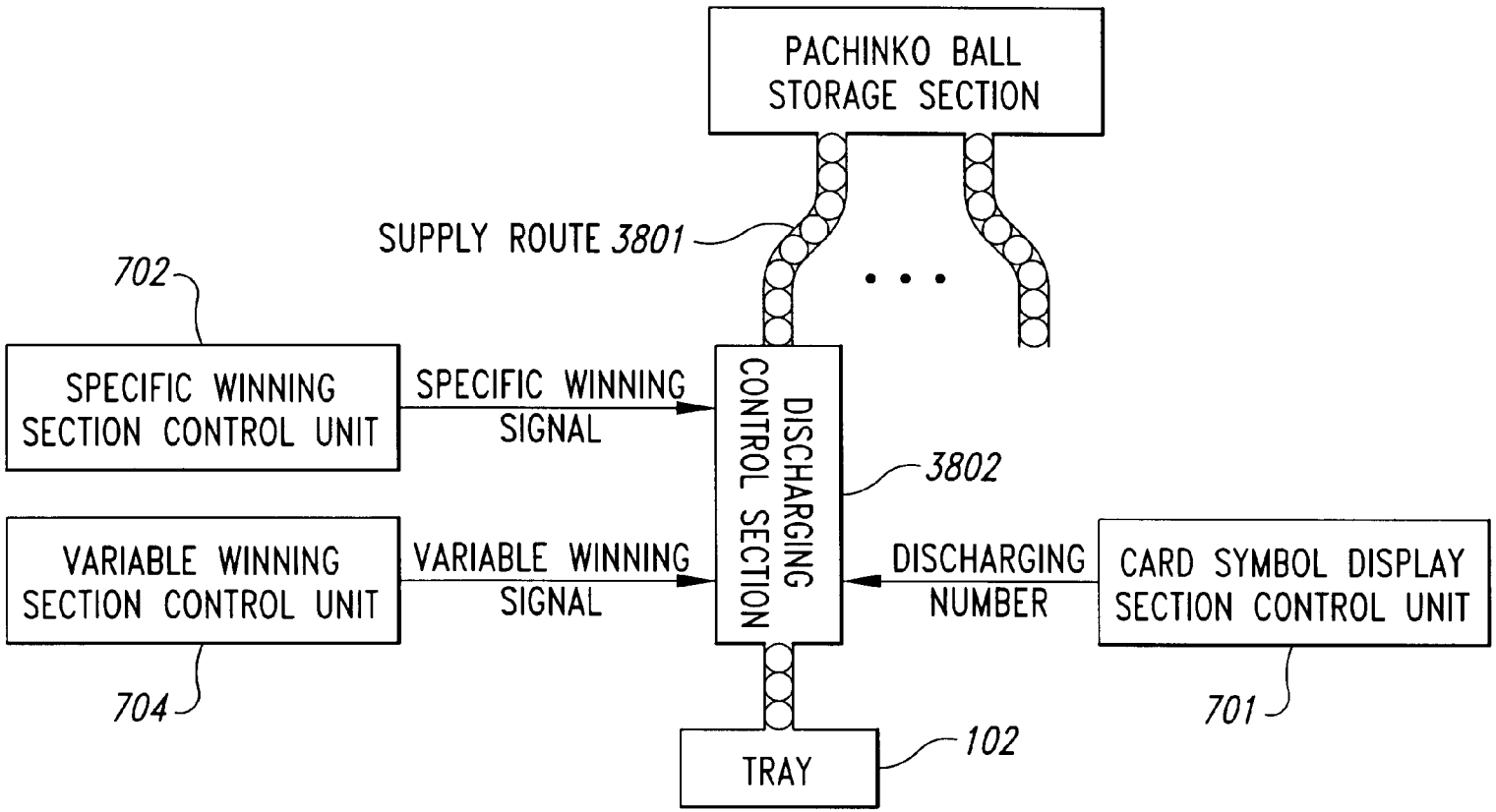
FIG. 34 is an explanatory view showing operation of a pachinko ball discharging device in the pachinko game machine of the fifth embodiment of the present invention.

As shown in FIG. 34, the pachinko ball discharging device 705 comprises a supply route 3801 which connects the pachinko ball storage section, where a large number of pachinko balls are stored, with the tray 102 of the pachinko game machine, and a discharging control section 3802 which discharges pachinko balls into the tray 102 by opening or shutting down the supply route 3801. The supply route 3801 is in the form of a tube whose diameter corresponds to that of a pachinko ball, and pachinko balls are put one by one in a line inside the supply route 3801 between the pachinko ball storage section and the discharging control section 3802.

Every time the discharging number of pachinko balls is outputted from the card symbol display section control unit 701, the discharging control section 3802 stores the discharging number in the memory inside.

In addition, the discharging control unit 3802 is designed to discharge seven pachinko balls into the tray 102, when a specific winning signal is outputted from the specific winning section control unit 702. Specifically, the discharging control section 3802 opens the supply route 3801 which is usually shut down, and counts the number of pachinko balls which have passed while the supply route 3801 is open. When seven pachinko balls have passed, the supply route 3801 is shut down again, so that seven pachinko balls are discharged into the tray 102.

The discharging control unit 3802 is designed to discharge pachinko balls into the tray 102, the number of which is currently stored in the internal memory when a variable winning signal is outputted from the variable winning section control unit 704. Specifically, the discharging control section 3802 opens the supply route 3801 which is usually shut down, and counts the number of pachinko balls which have passed while the supply route is open. When the discharging number of pachinko balls have passed, the supply route 3801 is shut down again, so that only the discharging number of pachinko balls are discharged into the tray 102.

Moreover, with the operations described above, even if the discharging number which the discharging control unit 3802 stores in the internal memory is maintained until the time another discharging number is outputted from the card symbol display section control unit 701, there is no problem.

By the way, in the aforementioned operational example of the pachinko game machine, it has been described that the card symbol display section control unit 701 determines five symbols and the discharging number of pachinko balls is decided according to the winning combination corresponding to the five symbols. Conversely, it is possible to determine the discharging number of pachinko balls in advance and then decide five symbols according to the determined discharging number. Hereinafter, such an example of the operation will be described with reference to FIG. 35.

In such a pachinko game machine, only the operation of the card symbol display section control unit 701 is different from the above described example.

Figure 35:
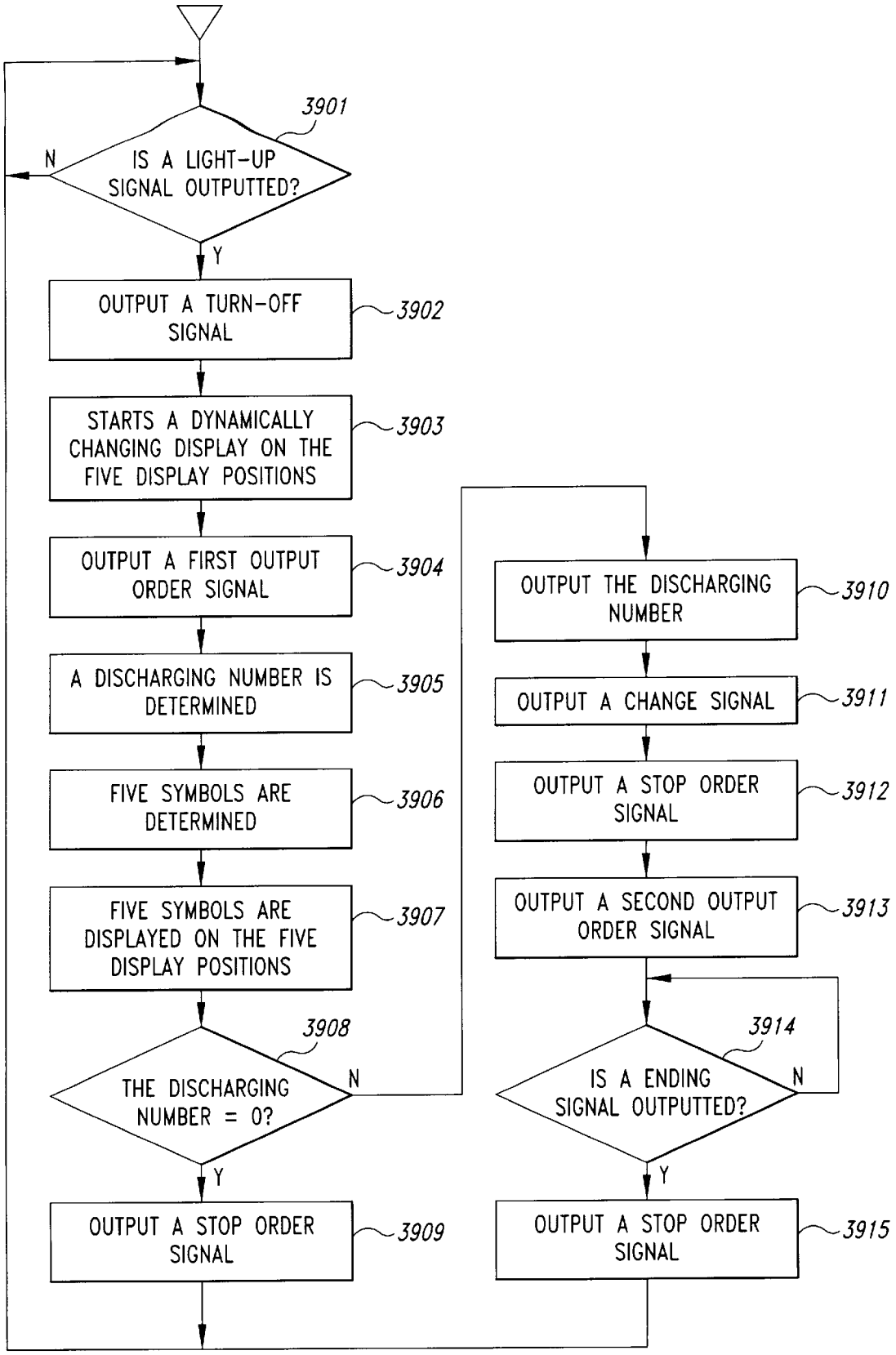
FIG. 35 is a flowchart showing another operational flow of the processor included in the card symbol display section control unit in the pachinko game machine of the fifth embodiment of the present invention.

FIG. 35 is a flowchart showing the operational flow of the processor 3401.

As shown in FIG. 35, in the card symbol display section control unit 701, in the case where a light-up signal is outputted from the winning number display section control unit 703 (step 3901), the processor 3401 outputs to the winning number display section control unit 703 a turn-off signal to let only one lamp go out (step 3902).

Subsequently, the processor 3401 controls the card symbol display section 107 to start a dynamically changing display of the symbols (representing the back of cards) on the five display positions (step 3903), and at the same time, outputs a first output order signal indicating a command to output the first sound effect to the sound effect output device 706 (step 3904).

Subsequently, the processor 3401 references the winning-combination-and-number table stored in the memory 3402, and determines a discharging number of pachinko balls including "0" (step 3905). Specifically, the processor 3401 determines a discharging number of pachinko balls from among the numbers "0", "2", "4", "6", "8", "10", and "15".

Subsequently, the processor 3401 references the winning-combination-and-number table stored in the memory 3402, and determines five symbols out of a plurality of card symbols in accordance with the discharging number of pachinko balls which has been determined in step 3905 (step 3906).

Subsequently, the processor 3401 controls the card symbol display section 107 so as to display the five symbols determined in step 3906 on each of the five display positions (step 3907).

Subsequently, the processor 3401 determines whether or not the discharging number which has been decided in step 3905 is "0" (step 3908), and in the case where it is "0", the processor 3401 outputs to the sound effect output device 706 a stop order signal, indicating a command to stop the first sound effect outputted from the sound effect output device 706 (step 3909), and then the operation returns to step 3901.

In the case where the discharging number which has been decided in step 3905 is other than "0", the processor 3401 outputs the discharging number to the pachinko ball discharging device 705 (step 3910).

Subsequently, the processor 3401 outputs a change signal as a command to change the variable winning section 105 into the big-winning state (step 3911).

Subsequently, the processor 3401 outputs to the sound effect output device 706 a stop order signal indicating a command to stop the first sound effect outputted by the sound effect output device 706 (step 3912), and at the same time, outputs to the sound effect output device 706 a second output order signal indicating a command to output the second sound effect (step 3913). The pachinko ball discharging device 705, as described above, discharges only the number of pachinko balls corresponding to the discharging number outputted from the card symbol display section control unit 701, for each of the pachinko balls which have dropped into the variable winning section 105.

The processor 3401 then waits for the ending signal outputted from the variable winning section control unit 704 (step 3914), so as to output to the sound effect output device 706 a stop order signal indicating a command to stop the second sound effect outputted from the sound effect output device 706 (step 3915), and then the operation returns to step 3901.

As described above, according to the gaming machine of the fifth embodiment, the discharging number of pachinko balls, which are discharged to the player for each of the pachinko balls having dropped into the variable winning section 105, varies in accordance with the strengths of the winning combinations of the poker game, to which the displayed symbols on the five display positions correspond, so that the stronger a winning combination is, the greater the level of enjoyment of a player, as in a case of playing a poker game. Therefore, the player can play the game enjoying the atmosphere of playing a poker game.

In the pachinko game machine of all the above embodiments except the second embodiment, if the operations where the number-of-changes (or the releasing time period, releasing number, or discharging number) is determined in advance, the probability values for forming each of the winning combinations may be made larger by adjusting the value of the number-of-changes (or the releasing time period, releasing number, or discharging number) in accordance with the winning combination.

Moreover, in the pachinko game machine of all the above embodiments except the second embodiment, if the operation where the number-of-changes (or the releasing time period, releasing number, or discharging number) is determined in advance, it is possible to set in advance for each of the winning combinations an upper limit to the number of times for forming a winning combinations within a predetermined period of time (for example, within one day's business hours). A pachinko game machine of the above first embodiment is modified to describe the above example as the sixth embodiment.

In the sixth embodiment, as shown in FIG. 36, the upper limit of the number of times to form "two pairs" is set to "100", the upper limit of the number of times to form "three of a kind" is set to "80", the upper limit of the number of times to form "straight" is set to "60", the upper limit of the number of times to form "flush" is set to "40", the upper limit of the number of times to form "full house" is set to "20", and the upper limit of the number of times to form "four of a kind" is set to "10".

In the pachinko game machine of the sixth embodiment, only the operation of the card symbol display section control unit 701 is different from the above described first embodiment, and thus the card symbol display section control unit 701 will be described with reference to FIGS. 37 to 39.

Figure 37:
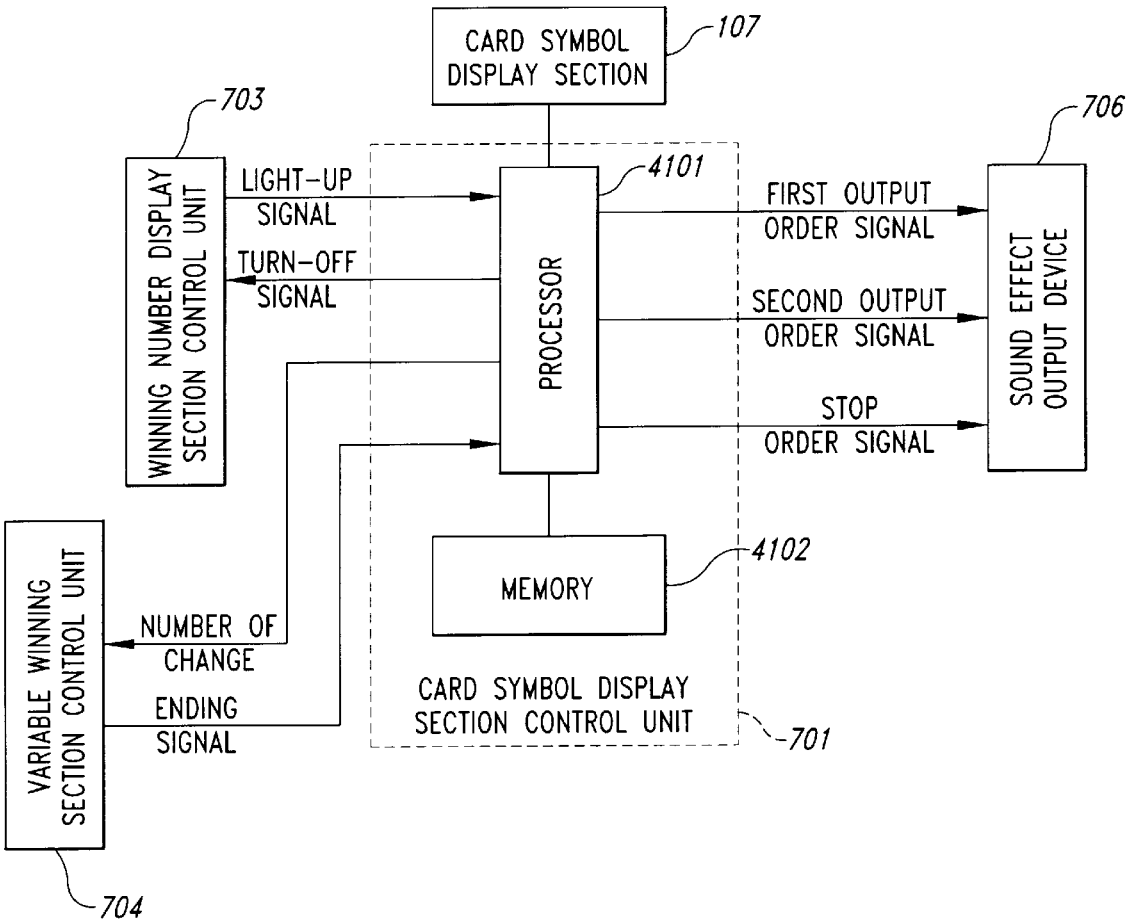
FIG. 37 is an explanatory view showing operation of a card symbol display section control unit in the pachinko game machine of the sixth embodiment of the present invention.

As shown in FIG. 37, the card symbol display section control unit 701 comprises a processor 4101 and a memory 4102, and the processor 4101 executes programs stored in the memory 4102 to perform the operation.

Figure 38:
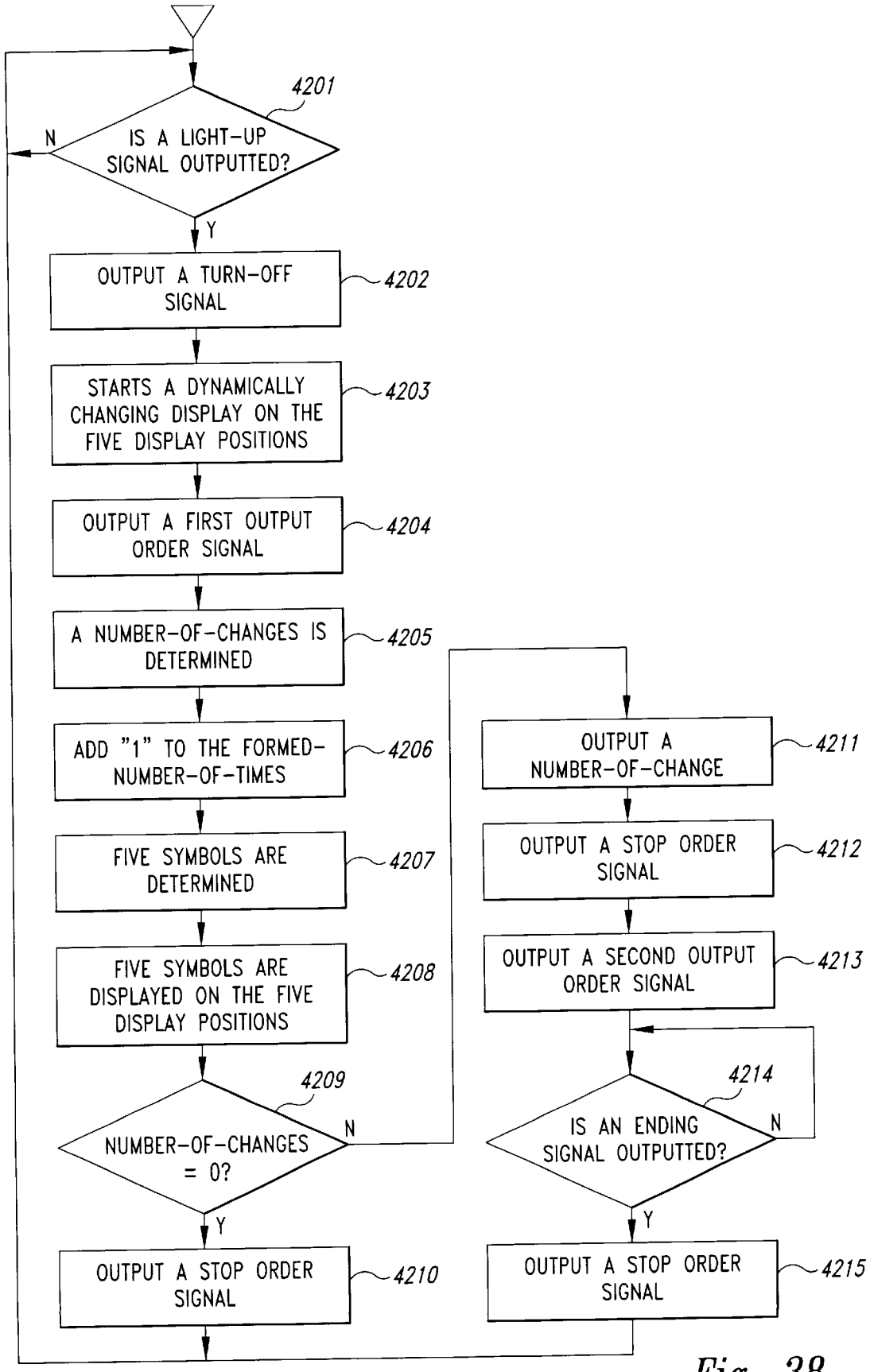
FIG. 38 is a flowchart showing an operational flow of a processor included in the card symbol display section control unit in the pachinko game machine of the sixth embodiment of the present invention.

FIG. 38 is a flowchart showing the operational flow of the processor 4101.

As shown in FIG. 38, in the card symbol display section control unit 701, in the case where a light-up signal is outputted from the winning number display section control unit 703 (step 4201), the processor 4101 outputs to the winning number display section control unit 703 a turn-off signal to let only one lamp go out (step 4202).

Subsequently, the processor 4101 controls the card symbol display section 107 to start a dynamically changing display of the symbols (representing the back of cards) on the five display positions (step 4203), and at the same time, outputs to the sound effect output device 706 a first output order signal indicating a command to output the first sound effect (step 4204).

Subsequently, the processor 4101 looks up the winning-combination-and-times table, and determines the number-of-changes including "0" (step 4205).

As shown in FIG. 39, there are stored in advance, in the winning-combination-and-times table 4301, the upper limit values of the number of times to form a winning combination for each of the winning combinations within the predetermined period of time (for example, one day's business hours), the conditions for forming the winning combinations, and the numbers-of-change in accordance with the winning combinations. Furthermore, it is designed to store the formed-number-of-times, which is the number of times each of the winning combinations has actually been formed.

In step 4205, the processor 4101 determines a number-of-changes from among "0", "2", "4", "6", "8", "10" and "16", and in order to assign weights to each of the numbers-of-change, the determination is performed in accordance with the probability value on the basis of the upper limit value and the formed-number-of-times stored in the winning-combination-and-times table 4301.

For example, in the case where the formed-number-of-times is "3" for all of the winning combinations, the probability value for determining the number-of-changes as "16" (that is, the probability value for forming "four of a kind") is set to 0.02%, the probability value for determining the number-of-changes as "10" (that is, the probability value for forming "full house") is set to 0.03%, the probability value for determining the number-of-changes as "8" (that is, the probability value for forming "flush") is set to 0.04%, the probability value for determining the number-of-changes as "6" (that is, the probability value for forming "straight") is set to 0.05%, the probability value for determining the number-of-changes as "4" (that is, the probability value for forming "three of a kind") is set to 0.08%, the probability value for determining the number-of-changes as "2" (that is, the probability value for forming "two pairs") is set to 0.15%, and the probability value for determining the number-of-changes as "0" (that is, the probability value for forming no winning combinations) is set to 99.63%.

Furthermore, for example, if the formed-number-of-times of "two pairs" is "50", in view of the upper limit value of "two pairs" which is "100", the probability value for determining the number-of-changes as "2" (that is, the probability value for forming "two pairs") is decreased to 0.075%, being half of 0.15%. At the same time, in order to adjust the decreased portion, the probability value to determine the number-of-changes as "0" (that is, the probability value for forming no winning combinations) is modified to 99.705% from 99.63%. As another example, if the formed-number-of-times of "four of a kind" is "10", in view of the upper limit value of "four of a kind" which is "10", the probability value for determining the number-of-changes as "16" (that is, the probability value for forming "four of a kind") is decreased to 0% from 0.15%, and at the same time, in order to adjust the decreased portion, the probability value to determine the number-of-changes as "0" (that is, the probability value for forming no winning combinations) is modified to 99.65% from 99.63%.

Subsequently, the processor 4101 adds "1" to the formed-number-of-times, which is stored in the winning-combination-and-times table 4301, in accordance with the number-of-changes determined in step 4205 (step 4206).

Subsequently, the processor 4101 references the winning-combination-and-times table 4301 and determines five symbols out of a plurality of card symbols in accordance with the number-of-changes which has been determined in step 4205 (step 4207).

Specifically, in the case where the number-of-changes is "16", the five symbols which form the winning combination "four of a kind" are determined, and where the number-of-changes is "10", the five symbols which form the winning combination "full house" are determined. Similarly, the five symbols are determined respectively in the case where the number-of-changes is "8" to form "flush", in the case where the number-of-changes is "6" to form "straight", in the case where the number-of-changes is "4" to form "three of a kind", and in the case where the number-of-changes is "2" to form "two pairs". In the case where the number-of-changes is "0", the five symbols which do not form any of the winning combinations are determined.

Subsequently, the processor 4101 controls the card symbol display section 107 so as to display the five symbols determined in step 4207 on each of the five display positions (step 4208).

Subsequently, the processor 4101 determines whether or not the number-of-changes which has been decided in step 4205 is "0" (step 4209), and in the case where it is "0", the processor 4101 outputs to the sound effect output device 706 a stop order signal, indicating a command to stop the first sound effect outputted from the sound effect output device 706 (step 4210), and then the operation returns to step 4201.

In the case where the number-of-changes which has been decided in step 4205 is other than "0", the processor 4101 outputs the number-of-changes to the variable winning section control unit 704 (step 4211).

Subsequently, the processor 4101 outputs to the sound effect output device 706 a stop order signal indicating a command to stop the first sound effect outputted by the sound effect output device 706 (step 4212), and at the same time, a second output order signal indicating a command to output the second sound effect to the sound effect output device 706 (step 4213).

The processor 4101 then waits for the ending signal outputted from the variable winning section control unit 704 (step 4214), so as to output to the sound effect output device 706 a stop order signal indicating a command to stop the second sound effect outputted from the sound effect output device 706 (step 4215), and then the operation returns to step 4201.

As described above, according to the gaming machine of the sixth embodiment, similarly to the above first embodiment, since the number of times the variable winning section 105 changes into the big-winning state varies in accordance with the strengths (levels) of the winning combinations of the poker game, to which the displayed symbols on the five display positions correspond, the stronger a winning combination is, the greater the level of enjoyment of a player, just like playing a poker game. Therefore, the player can play the game enjoying the atmosphere of playing a poker game.

Furthermore, according to the pachinko game machine of the sixth embodiment, a number of times to form each of the winning combination within a predetermined period of time (for example one day business hours) cannot exceed the upper limit which is fixed in advance in accordance with each of the winning combinations, and thus it is possible for every pachinko game machine to discharge to players pachinko balls approximately the same in total number.

In the sixth embodiment, an example to be applied to the first embodiment is described, however, it is also possible to apply the example to the above third to fifth embodiments in a similar way.

INDUSTRIAL FIELD OF UTILIZATION

The present invention can be utilized in a pachinko game machine, especially in a pachinko game machine having a display screen which can display various symbols on the gaming board.

What is claimed is:

1. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a symbol determination section for determining a predetermined number of symbols out of plural symbols of playing card when said specific winning section receives a pachinko ball;

a symbol display section for displaying each of the symbols determined by said symbol determination section;

a winning-combination-and-times storage section for storing therein, with respect to predetermined plural winning combinations in a card playing game, conditions for combinations of symbols for forming the winning combinations and numbers-of-times for said variable winning section to change into a big-winning state in accordance with the winning combinations;

a winning-combination judging section for judging whether or not the combination of the symbols determined by said symbol determination section forms any of the plural winning-combinations on the basis of the conditions stored in said winning-combination-and-times storage section; and a variable winning section control unit which allows, when said winning combination judging section judges one of the winning combinations is formed, said variable winning section to change into the big-winning state up to a number-of-times stored in said winning-combination-and-times storage section in accordance with the winning combination, and releases one big-winning state when a predetermined number of pachinko balls have dropped into said variable winning section or a predetermined time period lapses with regard to the one big-winning state.

2. The pachinko game machine having a card game playing function according to claim 1, wherein:

the numbers-of-times stored in said winning-combination-and-times storage section varies in value for each of the winning combinations, and the stronger the winning combination to which a number-of-times corresponds, the larger the value thereof.

3. The pachinko game machine having a card game playing function according to claim 1, further comprising:

a total value storage section which stores, from a time when the number-of-times is determined as maximum N until a time when the number-of-times is determined as N for the second time, a total value of the numbers-of-times determined as other than N in accordance with the winning combination formed by said winning-combination judging section, wherein, when the determined number-of-times is N, said variable winning section control unit allows said variable winning section to change into the big-winning state, instead of N, only the number-of-times which is obtained by subtracting from N the total value stored in said total value of the numbers-of-times.

4. The pachinko game machine having a card game playing function according to claim 1, wherein:

the predetermined plural winning-combinations in a card playing game, the conditions and the number-of-times for which are stored in said winning-combination-and-times storage section, are the predetermined plural winning-combinations in the poker game, and said symbol determination section determines five symbols out of the plural symbols of playing cards.

5. The pachinko game machine having a card game playing function according to claim 1, further comprising:

a discharging section for discharging a predetermined number of pachinko balls to a player, for each of the pachinko balls having dropped into said variable winning section.

6. The pachinko game machine having a card game playing function according to claim 1, wherein:

said symbol display section displays with a time lag each of the symbols determined by said symbol determination section.

7. The pachinko game machine having a card game playing function according to claim 1, wherein:

said symbol display section displays at least one predetermined symbol representing the back of card, before displaying each of the symbols determined in said symbol determination section.

8. The pachinko game machine having a card game playing function according to claim 1, comprising:

means for setting an upper limit to the number-of-times each of the winning combinations is formed, within a predetermined time period, and means for reducing the probability of forming each of the winning combinations in accordance with the increase of formed-number-of-times of each of the winning combinations.

9. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a symbol determination section for determining a predetermined number of symbols out of plural symbols of playing card when said specific winning section receives a pachinko ball;

a symbol display section for displaying each of the symbols determined by said symbol determination section;

a winning-combination-and-time-period storage section for storing therein, with respect to predetermined plural winning combinations in a card playing game, conditions for combinations of symbols for forming the winning combinations and time periods for said variable winning section to be in a big-winning state in accordance with the winning combinations;

a winning-combination judging section for judging whether or not the combination of the symbols determined by said symbol determination section forms any of the plural winning-combinations on the basis of the conditions stored in said winning-combination-and-time-period storage section; and a variable winning section control unit which allows, when said winning combination judging section judges one of the winning combinations is formed, said variable winning section to change into in the big-winning state up to a predetermined number-of-times, while releases one big-winning state when a predetermined number of pachinko balls have dropped into said variable winning section or a time period stored in said winning-combination-and-time-period storage section lapses with regard to the one big-winning state.

10. The pachinko game machine having a card game playing function according to claim 9, wherein:

the time period stored in said winning-combination-and-time-period storage section varies in value for each of the winning combinations, and the stronger the winning combination to which a time period corresponds, the larger the value thereof.

11. The pachinko game machine having a card game playing function according to claim 9, wherein:

the predetermined plural winning combinations in a card playing game, the conditions and the time periods for which are stored in said winning-combination-and-time-period storage section, are the predetermined plural winning combinations in the poker game, and said symbol determination section determines five symbols out of the plural symbols of playing cards.

12. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a symbol determination section for determining a predetermined number of symbols out of plural symbols of playing card when said specific winning section receives a pachinko ball;

a symbol display section for displaying each of the symbols determined by said symbol determination section;

a winning-combination-and-number storage section for storing therein, with respect to predetermined plural winning combinations in a card playing game, conditions for combinations of symbols for forming the winning combinations and winning numbers of pachinko balls which trigger said variable winning section to release a big-winning state in accordance with the winning combinations;

a winning-combination judging section for judging whether or not the combination of the symbols determined by said symbol determination section forms any of the plural winning-combinations on the basis of the conditions stored in said winning-combination-and-number storage section; and a variable winning section control unit which allows, when said winning combination judging section judges one of the winning combinations is formed, said variable winning section to change into the big-winning state up to a predetermined number-of-times, and releases one big-winning state when a number of pachinko balls stored in said winning-combination-and-number storage section have dropped into said variable winning section or a predetermined time period lapses with regard to the one big-winning state.

13. The pachinko game machine having a card game playing function according to claim 12, wherein:

the numbers stored in said winning-combination-and-number storage section vary in value for each of the winning combinations, and the stronger the winning combination to which a number corresponds, the larger the value thereof.

14. The pachinko game machine having a card game playing function according to claim 12, wherein:

the predetermined plural winning-combinations in a card playing game, the conditions and the numbers for which are stored in said winning-combination-and-number storage section, are the predetermined plural winning-combinations in the poker game, and said symbol determination section determines five symbols out of the plural symbols of playing cards.

15. A pachinko game machine having a card game playing function, comprising:

a specific winning section provided on a gaming board which is capable of receiving a pachinko ball;

a variable winning section provided on said gaming board, which is usually closed and changes into a big-winning state for receiving a plurality of pachinko balls at a time;

a symbol determination section for determining a predetermined number of symbols out of plural symbols of playing card when said specific winning section receives a pachinko ball;

a symbol display section for displaying each of the symbols determined by said symbol determination section;

a winning-combination-and-number storage section for storing therein, with respect to predetermined plural winning combinations in a card playing game, conditions for combinations of symbols for forming the winning combinations and numbers of pachinko balls to be discharged to a player for each of the pachinko balls having dropped into said variable winning section in accordance with the winning combinations;

a winning-combination judging section for judging whether or not the combination of the symbols determined by said symbol determination section forms any of the plural winning-combinations on the basis of the conditions stored in said winning-combination-and-number storage section;

a variable winning section control unit which allows, when said winning combination judging section judges one of the winning combinations is formed, said variable winning section to change into the big-winning state up to a predetermined number-of-times, and releases one big-winning state when a predetermined number of pachinko balls have dropped into said variable winning section or a predetermined time period lapses with regard to the one big-winning state; and a discharging section for discharging a number of pachinko balls to the player, the number being stored in said winning-combination-and-number storage section in accordance with the winning combination, for each of the pachinko balls having dropped into said variable winning section.

16. The pachinko game machine having a card game playing function according to claim 15, wherein:

the numbers stored in said winning-combination-and-number storage section vary in values for each of the winning combinations, and the stronger the winning combination to which a number corresponds, the larger the value thereof.

17. The pachinko game machine having a card game playing function according to claim 15, wherein:

the predetermined plural winning-combinations in a card playing game, the conditions and the number for which are stored in said winning-combination-and-number storage section, are the predetermined plural winning-combinations in the poker game, and said symbol determination section determines five symbols out of the plural symbols representing respectively playing cards.

18. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a winning-combination-and-times storage section for storing therein, with respect to predetermined plural winning combinations in a card playing game, conditions for combinations of symbols for forming the winning combinations and numbers-of-times for said variable winning section to change into a big-winning state in accordance with the winning combinations;

a number-of-times determination section which determines whether or not said variable winning section is changed into a big-winning state when a pachinko ball drops into said specific winning section, and which determines a number-of-times out of a plurality of numbers-of-times stored in said winning-combination-and-times storage section in the case where it is determined that said variable winning section is changed into a big-winning state;

a symbol determination section for determining a predetermined number of symbols out of plural symbols of playing card in accordance with the number-of-times determined in said number-of-times determination section so as to form a combination which satisfies the condition stored in said winning-combination-and-times storage section;

a symbol display section for displaying each of the symbols determined by said symbol determination section; and a variable winning section control unit which allows, after said symbol display section completes displaying the symbols, said variable winning section to change into the big-winning-state only said number-of-times determined in said number-of-times determination section, and releases the big-winning state when a predetermined number of pachinko balls have dropped into said variable winning section or a predetermined time period lapses with respect to one big-winning-state.

19. The pachinko game machine having a card game playing unction according to claim 18, wherein:

the numbers-of-times stored in said winning-combination-and-times storage section vary in value for each of the winning combinations, and the stronger the winning combination to which a number-of-times corresponds, the larger the value thereof.

20. The-pachinko game machine having a card game playing function according to claim 18, further comprising a total value storage section which stores a total value of the numbers-of-times determined as other than N by said number-of-times determination section, from a time when the number-of-times is determined as maximum N until a time when the number-of-times is determined as N for the second time, wherein, when the number-of-times determined by said number-of-times determination section is N, said variable winning section control unit allows said variable winning section to change into the big-winning state instead of N, only the number-of-times which is obtained by subtracting from N the total value stored in said total value of the numbers-of-times.

21. The pachinko game machine having a card game playing function according to claim 18, wherein:

the predetermined plural winning-combinations in a card playing game, the conditions and the number-of-times for which are stored in said winning-combination-and-times storage section, are the predetermined plural winning-combinations in the poker game, and said symbol determination section determines five symbols out of the predetermined plural symbols of playing cards, so as to form a combination which satisfies the condition stored in said winning-combination-and-times storage section, in accordance with the number-of-times determined by said number-of-times determination section.

22. The pachinko game machine having a card game playing function according to claim 18, further comprising a discharging section for discharging a predetermined number of pachinko balls to a player for each of the pachinko balls having dropped into said variable winning section.

23. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a winning-combination-and-time-period storage section for storing therein, with respect to predetermined plural winning combinations in a card playing game, conditions for combinations of symbols for forming the winning combinations and time periods for said variable winning section to be in a big-winning state in accordance with the winning combinations;

a time period determination section which determines whether or not said variable winning section is changed into a big-winning state when a pachinko ball drops into said specific winning section, and which determines a time period out of a plurality of time periods stored in said winning-combination-and-time-period storage section in the case where it is determined that said variable winning section is changed into a big-winning state;

a symbol determination section for determining a predetermined number of symbols out of plural symbols of playing card in accordance with the time period determined in said time period determination section so as to form a combination which satisfies the condition stored in said winning-combination-and-time-period storage section;

a symbol display section for displaying each of the symbols determined by said symbol determination section; and a variable winning section control unit which allows, after said symbol display section completes displaying the symbols, said variable winning section to change into the big-winning-status only a predetermined number-of-times, and releases the big-winning state when a predetermined number of pachinko balls have dropped into said variable winning section or the time period determined in said time period determination section lapses with respect to one big-winning-status.

24. The pachinko game machine having a card game playing unction according to claim 23, wherein:

the time periods stored in said winning-combination-and-time-period storage section vary in value for each of the winning combinations, and the stronger the winning combination to which a time period corresponds, the larger the value thereof.

25. The pachinko game machine having a card game playing unction according to claim 23, wherein:

the predetermined plural winning-combinations in a card playing game, the conditions and the time periods for which are stored in said winning-combination-and-time-period storage section, are the predetermined plural winning-combinations in the poker game, and said symbol determination section determines five symbols out of the predetermined plural symbols of playing cards, so as to form a combination which satisfies the condition stored in said winning-combination-and-time-period storage section, in accordance with the time period determined by said time period determination section.

26. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a winning-combination-and-number storage section for storing therein, with respect to predetermined plural winning combinations in a card playing game, conditions for combinations of symbols for forming the winning combinations and numbers of pachinko balls which trigger that said variable winning section releases a big-winning state in accordance with the winning combinations;

a number determination section which determines whether or not said variable winning section is changed into a big-winning state when a pachinko ball drops into said specific winning section, and which determines a number out of a plurality of numbers stored in said winning-combination-and-number storage section in the case where it is determined that said variable winning section is changed into a big-winning state;

a symbol determination section for determining a predetermined number of symbols out of predetermined plural symbols of playing cards so as to form a combination which satisfies the condition stored in said winning-combination-and-number storage section, in accordance with the number determined by said number determination section;

a symbol display section for displaying each of the symbols determined by said symbol determination section; and a variable winning section control unit which allows, after said symbol display section completes displaying the symbols, said variable winning section to change into the big-winning state up to a predetermined number-of-times, and releases one big-winning state when the number of pachinko balls determined in said number determination section have dropped into said variable winning section or a predetermined time period lapses with regard to the one big-winning state.

27. The pachinko game machine having a card game playing function according to claim 26, wherein: the numbers stored in said winning-combination-and-number storage section vary in value for each of the winning combinations, and the stronger the winning combination to which a number corresponds, the larger the value thereof.

28. The pachinko game machine having a card game playing function according to claim 26, wherein:

the predetermined plural winning combinations in a card game, the conditions and the number for which are stored in said winning-combination-and-number storage section, are the predetermined plural winning combinations in the poker game, and said symbol determination section determines five symbols out of the predetermined plural symbols of playing cards, so as to form a combination which satisfies the condition stored in said winning-combination-and-number storage section, in accordance with the number determined by said number determination section.

29. A pachinko game machine having a card game playing function, comprising:

a specific winning section provided on a gaming board, which is capable of receiving a pachinko ball;

a variable winning section provided on said gaming board, which is usually closed and changes into a big-winning state for receiving a plurality of pachinko balls at a time;

a winning-combination-and-number storage section for storing therein, with respect to plural predetermined winning combinations in a card playing game, conditions for combinations of symbols for forming the winning combinations and numbers of pachinko balls to be discharged to a player for each of pachinko balls having dropped into said variable winning section, in accordance with the winning combinations;

a number determination section which determines whether or not said variable winning section is changed into a big-winning state when a pachinko ball drops into said specific winning section, and which determines a number out of a plurality of numbers stored in said winning-combination-and-number storage section in the case where it is determined that said variable winning section is changed into a big-winning state;

a symbol determination section for determining a predetermined number of symbols out of a plurality of symbols of playing card so as to form a combination which satisfies the condition stored in said winning-combination-and-number storage section in accordance with the number determined by said number determination section;

a symbol display section for displaying each of the symbols determined by said symbol determination section;

a variable winning section control unit which allows, after said symbol display section completes displaying the symbols, said variable winning section to change into the big-winning state up to a predetermined number-of-times, and releases one big-winning state when a predetermined number of pachinko balls have dropped into said variable winning section or a predetermined time period lapses with regard to the one big-winning state; and a discharging section for discharging to a player the number of pachinko balls determined by said number determination section for each of the pachinko balls having dropped into said variable winning section.

30. The pachinko game machine having a card game playing unction according to claim 29, wherein:

the numbers stored in said winning-combination-and-number storage section vary in values for each of the winning combinations, and the stronger the corresponding winning combination, the larger the value.

31. The pachinko game machine having a card game playing unction according to claim 29, wherein:

the predetermined plural winning-combinations in a card playing game, the conditions and the number for which are stored in said winning-combination-and-number storage section, are the predetermined plural winning-combinations in the poker game, and said symbol determination section determines five symbols out of the predetermined plural symbols of playing cards, so as to form a combination which satisfies the condition stored in said winning-combination-and-number storage section, in accordance with the number determined by said number determination section.

* * * * *